US009565500B2

(12) United States Patent
Kim et al.

(10) Patent No.: US 9,565,500 B2
(45) Date of Patent: Feb. 7, 2017

(54) APPARATUS AND METHOD FOR CANCELING FEEDBACK IN HEARING AID

(71) Applicant: Samsung Electronics Co., Ltd., Suwon-si, Gyeonggi-do (KR)

(72) Inventors: Jung-Soo Kim, Hwaseong-si (KR); Yang-Wook Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 20 days.

(21) Appl. No.: 14/640,638

(22) Filed: Mar. 6, 2015

(65) Prior Publication Data

US 2015/0256947 A1 Sep. 10, 2015

(30) Foreign Application Priority Data

Mar. 7, 2014 (KR) ..... 10-2014-0027390

(51) Int. Cl.
*H04R 25/00* (2006.01)

(52) U.S. Cl.
CPC ..... *H04R 25/45* (2013.01); *H04R 25/554* (2013.01)

(58) Field of Classification Search
CPC ..... H04R 25/00; H04R 25/55; H04R 25/558; H04R 2225/49; H04R 2460/01
USPC . 381/312, 315, 317–318, 320–321; 455/41.1
See application file for complete search history.

(56) References Cited

U.S. PATENT DOCUMENTS 6,021,207 A * 2/2000 Puthuff ..... H04B 1/385 381/315
6,240,192 B1 * 5/2001 Brennan ..... H04R 25/505 381/312
8,041,062 B2 * 10/2011 Cohen ..... H04R 1/1016 381/315
8,280,086 B2 * 10/2012 Topholm ..... H04R 25/558 381/312
8,559,663 B1 * 10/2013 Sacha ..... H04R 25/43 381/315
8,891,793 B1 * 11/2014 Sacha ..... H04R 25/558 381/315
2004/0203351 A1 * 10/2004 Shearer ..... H04M 1/6066 455/41.1
2005/0058313 A1 * 3/2005 Victorian ..... H04R 25/554 381/315
2005/0069161 A1 3/2005 Kaltenbach et al.
2007/0082612 A1 4/2007 Valve et al.
2010/0278365 A1 11/2010 Biundo Lotito et al.
2010/0303268 A1 * 12/2010 Frerking ..... H04M 1/72591 381/315
2011/0032071 A1 * 2/2011 Tondering ..... H04B 1/202 340/4.31
2011/0319018 A1 * 12/2011 Kroman ..... H04R 25/554 455/41.1
2013/0010973 A1 * 1/2013 Ma ..... H04R 25/356 381/315
2013/0034234 A1 2/2013 Chen et al.
(Continued)

FOREIGN PATENT DOCUMENTS

KR 10-2008-0014346 A 2/2008

*Primary Examiner* — Suhan Ni
(74) *Attorney, Agent, or Firm* — Jefferson IP Law, LLP

(57) ABSTRACT

A method of operating an electronic device is provided. The method includes transmitting, by the electronic device, a control signal for controlling a microphone sensitivity of a hearing aid, to the hearing aid, and transmitting a reception signal from a counterpart electronic device to the hearing aid.

29 Claims, 18 Drawing Sheets

(56) References Cited

U.S. PATENT DOCUMENTS

| | | | | |
|---|---|---|---|---|
| 2013/0070945 | A1 | 3/2013 | Fusakawa et al. | |
| 2013/0072229 | A1 | 3/2013 | Schnurr | |
| 2013/0129126 | A1 | 5/2013 | Callias et al. | |
| 2013/0237154 | A1* | 9/2013 | Frerking ..... | H04M 1/6066<br>455/41.1 |
| 2013/0243209 | A1 | 9/2013 | Zurbruegg et al. | |
| 2014/0355799 | A1* | 12/2014 | Rasmussen ..... | H04R 25/554<br>381/315 |

* cited by examiner

APPARATUS AND METHOD FOR CANCELING FEEDBACK IN HEARING AID

CROSS-REFERENCE TO RELATED APPLICATION(S)

This application claims the benefit under 35 U.S.C. §119 (a) of a Korean patent application filed on Mar. 7, 2014 in the Korean Intellectual Property Office and assigned Ser. No. 10-2014-0027390, the entire disclosure of which is hereby incorporated by reference.

TECHNICAL FIELD

The present disclosure relates to an apparatus and method for preventing a feedback phenomenon in a hearing aid.

BACKGROUND

As people age there is an increased suffering from geriatric diseases. Specifically, due to the misuse of portable electronic devices, as the population ages there has been an increased loss of hearing. Hearing aids can fix problems resulting from poor hearing of hard-of-hearing patients. For example, the hearing aid is installed in an ear of the hard-of-hearing patient, and amplifies a sound introduced through a microphone adaptively to a characteristic of a hearing sense of the hard-of-hearing patient and outputs the amplified sound through a speaker (or a receiver), thereby being able to correct the poor hearing of the hard-of-hearing patient.

As the hearing aid is miniaturized for easy installation in the ear of the hard-of-hearing patient, a distance between the microphone and the speaker becomes short and thus, a feedback phenomenon can take place in which a sound signal outputted from the speaker or a sound signal reflected from an external auditory canal is fed back to the microphone and is again amplified in the microphone. In accordance to this, the hearing aid requires a way for decreasing a feedback phenomenon.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an apparatus and method for preventing a feedback phenomenon of a hearing aid.

In accordance with an aspect of the present disclosure, a method of operating an electronic device is provided. The method includes transmitting, by the electronic device, a control signal for controlling a microphone sensitivity of a hearing aid, to the hearing aid, and transmitting a reception signal provided from a counterpart electronic device to the hearing aid.

In accordance with an aspect of the present disclosure, a method of operating an electronic device is provided. The method includes transmitting, by the electronic device, a control signal for controlling a microphone sensitivity of a hearing aid, to the hearing aid, and transmitting a sound signal collected through a microphone of the electronic device, to the hearing aid.

In accordance with another aspect of the present disclosure, a method of operating a hearing aid is provided. The method includes controlling, by the hearing aid, a microphone sensitivity of the hearing aid based on a control signal provided from an electronic device, amplifying a sound signal provided from the electronic device, and outputting the amplified signal to a speaker of the hearing aid.

In accordance with another aspect of the present disclosure, an electronic device is provided. The electronic device includes a microphone, a speaker, a communication module, and a processor configured to transmit a control signal for controlling a microphone sensitivity of a hearing aid, to the hearing aid through the communication module, and to transmit a reception signal provided from a counterpart electronic device to the hearing aid through the communication module.

In accordance with another aspect of the present disclosure, an electronic device is provided. The electronic device includes a microphone, a speaker, a communication module, and a processor configured to transmit a control signal for controlling a microphone sensitivity of a hearing aid, to the hearing aid through the communication module, and to transmit a sound signal collected through a microphone of the electronic device, to the hearing aid.

In accordance with another aspect of the present disclosure, a hearing aid apparatus is provided. The hearing aid apparatus includes at least one microphone, a speaker, a communication module, and a processor configured to control a microphone sensitivity of the hearing aid based on a control signal provided from an electronic device, to amplify a sound signal provided from the electronic device through the communication module, and to output the amplified sound signal to a speaker of the hearing aid.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
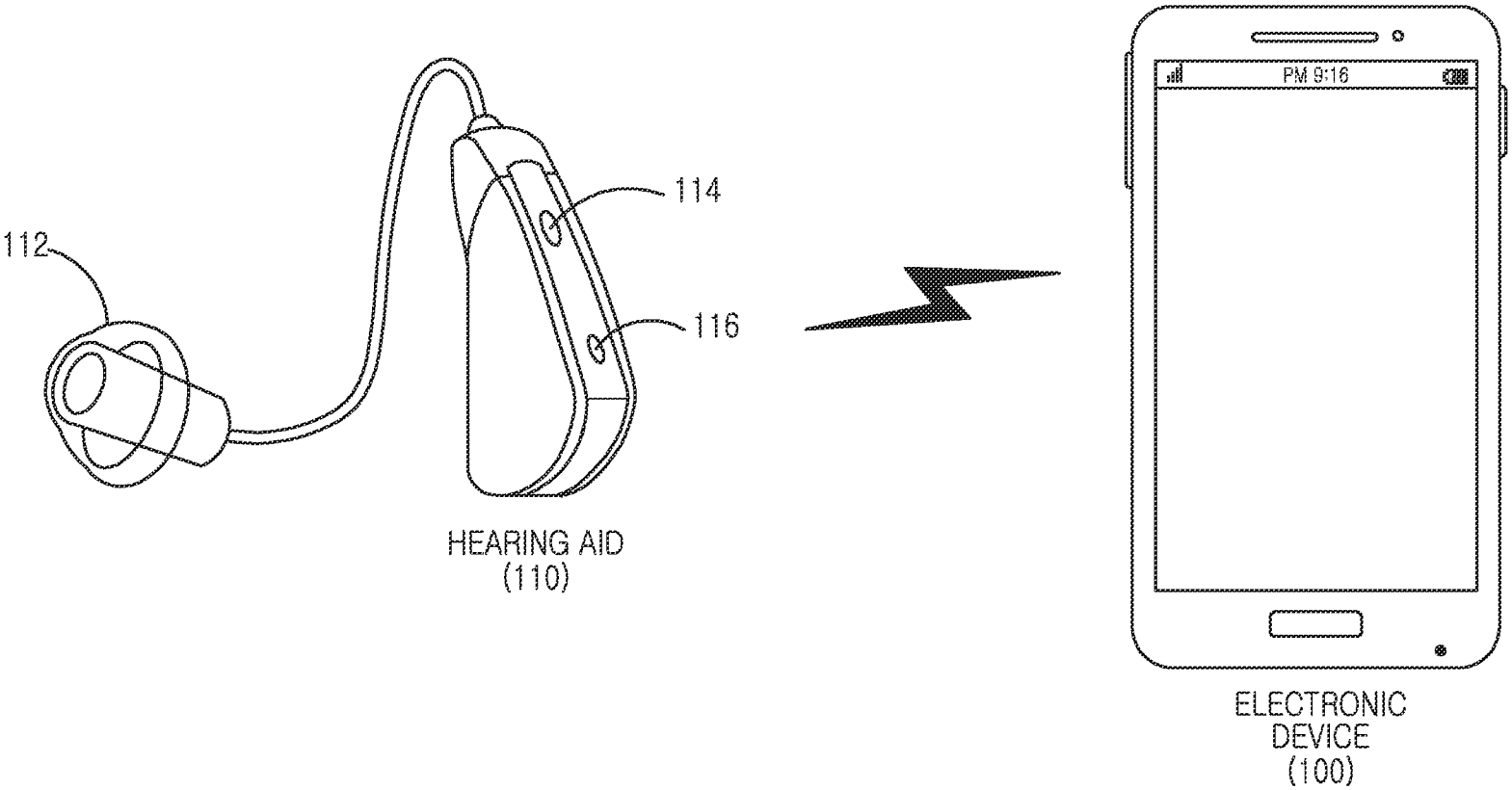
FIG. 1 illustrates a construction of a hearing aid and an electronic device between which communication has been connected according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The expressions "comprise," "may comprise" and the like usable in the various embodiments of the present disclosure indicate the existence of disclosed corresponding functions, operations, constituent elements or the like, and do not limit additional one or more functions, operations, constituent elements or the like. Also, it should be understood that the terms "comprise," "have" and the like in the various embodiments of the present disclosure are to designate the existence of features stated in the specification, numerals, operations, constituent elements, components, and/or a combination thereof, and are not to previously exclude the possibility of existence or an addition of one or more other features, numerals, operations, constituent elements, components, and/or combinations thereof.

The expressions such as "or" and the like in the various embodiments of the present disclosure include any and all combinations of words enumerated together. For example, "A or B" may include A, may include B, or may include all A and B.

The expressions such as "1st," "2nd," "first," "second," and the like used in the various embodiments of the present disclosure may modify various constituent elements of various embodiments, but do not intend to limit the corresponding constituent elements. For example, the expressions do not limit the order and/or importance and the like of the corresponding constituent elements. The expressions may be used to distinguish one constituent element from another constituent element. For example, all of a 1st user device and a 2nd user device are user devices, and represent different user devices. For example, a 1st constituent element may be named as a 2nd constituent element without departing from the scope of right of the various embodiments of the present disclosure. Likely, even a 2nd constituent element may be named as a 1st constituent element.

When it is mentioned that any constituent element is "coupled" and/or "connected" to another constituent element, the any constituent element may be directly coupled or connected to the another constituent element, but it should be understood that new other constituent element may also exist between the any constituent element and the another constituent element. In contrast, when it is mentioned that any constituent element is "directly coupled" and/or "directly connected" to another constituent element, it should be understood that no new other constituent element exists between the any constituent element and the another constituent element.

The terms used in the various exemplary embodiments of the present disclosure are used for just describing specific exemplary embodiments, and do not intend to limit the various exemplary embodiments of the present disclosure. The expression of singular number includes the expression of plural number unless the context clearly dictates otherwise.

Unless defined otherwise, all the terms used herein including the technological or scientific terms have the same meaning as those commonly understood by a person having ordinary knowledge in the art which various embodiments of the present disclosure belong to. The terms as defined in a general dictionary should be interpreted as having the same meanings as the contextual meanings of a related technology, and are not interpreted as having ideal or excessively formal meanings unless defined clearly in various embodiments of the present disclosure.

An electronic device according to various embodiments of the present disclosure may be a device including a telecommunication function. For example, the electronic device may include at least one of a smart phone, a tablet Personal Computer (PC), a mobile phone, a video phone, an electronic book (e-book) reader, a desktop PC, a laptop PC, a netbook computer, a Personal Digital Assistant (PDA), a Portable Multimedia Player (PMP), an MPEG Audio Layer 3 (MP3) player, a mobile medical instrument, a camera, or a wearable device (e.g., a Head Mounted Display (HMD) such as electronic glasses, electronic clothes, an electronic bracelet, an electronic necklace, an appcessory, an electronic tattoo, and/or a smart watch).

According to various embodiments, the electronic device may be smart home appliances having a telecommunication function. The smart home appliances may include, for example, at least one of a television, a Digital Versatile Disc (DVD) player, an audio system, a refrigerator, an air conditioner, a cleaner, an oven, a microwave, a washing machine, an air cleaner, a set-top box, a TV box (for example, Samsung HomeSync™, Apple TV™, and/or Google TV™), a game console, an electronic dictionary, an electronic locking system, a camcorder, and an electronic frame.

According to various embodiments, the electronic device may include at least one of various medical instruments including telecommunication functions (e.g., Magnetic Resonance Angiography (MRA), Magnetic Resonance Imaging (MRI), Computerized Tomography (CT), a moving-camera, an ultrasonic machine and the like), a navigation device, a Global Positioning System (GPS) receiver, an Event Data Recorder (EDR), a Flight Data Recorder (FDR), a car infotainment device, electronic equipment for a ship (e.g., a navigation device for a ship, a gyrocompass and the like), avionics, a security instrument, and/or an industrial or home robot.

According to various embodiments, the electronic device may include at least one of a part of furniture or building/structure including a telecommunication function, an electronic board, an electronic signature receiving device, a projector, and/or various measuring/metering instruments (e.g., a tap water measuring instrument, an electricity measuring instrument, a gas measuring instrument, a radio wave measuring instrument and/or the like). The electronic device according to the present disclosure may be one of the aforementioned various devices or a combination of two or more. Also, it is obvious to those skilled in the art that the electronic device according to the present disclosure is not limited to the aforementioned instruments.

An electronic device according to various embodiments of the present disclosure will be described with reference to the accompanying drawings. The term 'user' used in the various embodiments may denote a person who uses the electronic device and/or a device (e.g., an artificial intelligent electronic device) which uses the electronic device.

An embodiment of the present disclosure describes a technology for preventing a feedback phenomenon of a hearing aid.

Various embodiments of the present disclosure describe a digital hearing aid of a Receiver In the Canal (RIC) type for example, but are identically applicable to a digital and/or analog hearing aid of other type that is wearable on a user (e.g., a hearing aid of a Completely in the Canal (CIC) type).

FIGS. 1 through 18, discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the present disclosure. Terms first, second, and the like are used to differentiate between objects having the same terminology and are in no way intended to represent a chronological order, unless where explicitly stated otherwise. A set is defined as a non-empty set including at least one element.

FIG. 1 illustrates a construction of a hearing aid and an electronic device between which communication has been connected according to an embodiment of the present disclosure.

Referring to FIG. 1, an electronic device 100 and a hearing aid 110 are illustrated, where the electronic device 100 and the hearing aid 110 connect, communicate and transmit/receive data with each other. For example, the electronic device 100 and the hearing aid 110 may communicate using a short-range communication method. Here, the short-range communication method may include one or more of Wireless Fidelity (WiFi), Bluetooth, Zigbee, or Near Field Communication (NFC). For example, the electronic device 100 and the hearing aid 110 may transmit/receive data using a Bluetooth Low Energy (BLE) protocol communication method, thereby decreasing the power consumption of the hearing aid 110. The electronic device 100 and the hearing aid 110 may deform a data transmission interval or a data transmission duration defined in the BLE protocol such that transmission of a sound signal is possible, and may transmit/receive the sound signal with each other.

To prevent a feedback phenomenon of the hearing aid 110, the electronic device 100 can control a microphone sensitivity of the hearing aid 110. For example, the electronic device 100 may transmit, to the hearing aid 110, a microphone sensitivity control signal for decreasing the microphone sensitivity of the hearing aid 110 based on a communication state with the hearing aid 110. For instance, if communication is performed with the hearing aid 110, the electronic device 100 may transmit, to the hearing aid 110, the microphone sensitivity control signal for decreasing the microphone sensitivity of the hearing aid 110. Furthermore, for example, if sensing the occurrence of an event (e.g., a telephony event) with a counterpart electronic device, the electronic device 100 can transmit, to the hearing aid 110, the microphone sensitivity control signal for decreasing the microphone sensitivity of the hearing aid 110.

The hearing aid 110 may control a sensitivity of a microphone 114 or 116 of the hearing aid 110 based on a microphone sensitivity control signal provided from the electronic device 100. For example, the hearing aid 110 may control the microphone sensitivity, such that the microphone 114 or 116 is inactivated, based on the microphone sensitivity control signal provided from the electronic device 100. The hearing aid 110 may amplify a sound signal provided from the electronic device 100 and output the amplified sound signal through a speaker (or receiver) 112.

Figure 2:
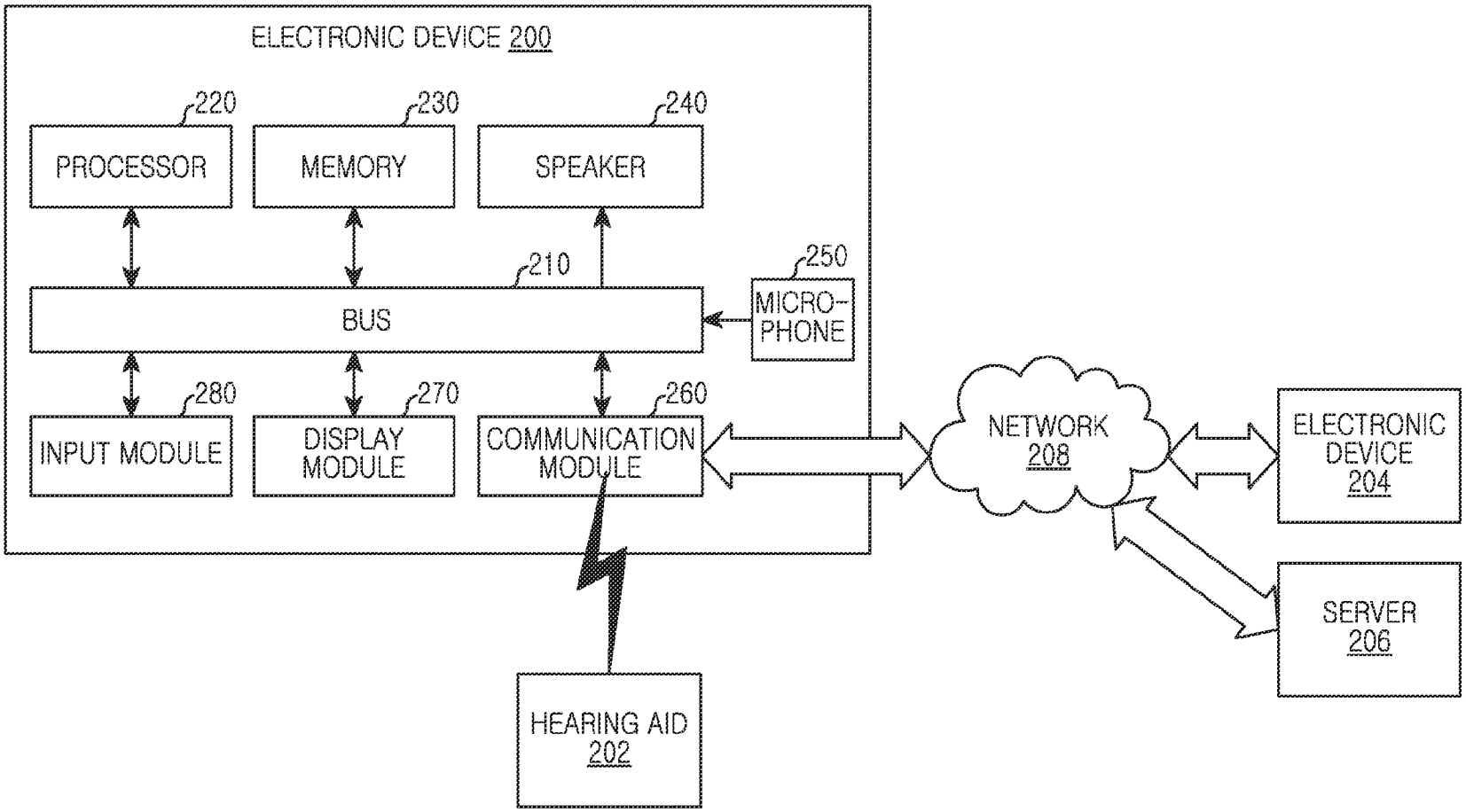
FIG. 2 illustrates a block diagram of an electronic device according to an embodiment of the present disclosure.

FIG. 2 illustrates a block diagram of an electronic device according to an embodiment of the present disclosure.

Referring to FIG. 2, an electronic device 200 (e.g., the electronic device 100 of FIG. 1) is illustrated, where the electronic device 200 may include a bus 210, a processor 220, a memory 230, a speaker 240, a microphone 250, a communication module (i.e., a communication interface) 260, a display module 270, and/or an input module (i.e., an input interface) 280. Here, one or more of the processor 220 and/or the memory 230 may exist in plural.

The bus 210 may connect constituent elements included in the electronic device 200 with one another, and control communication between the constituent elements included in the electronic device 200.

The processor 220 may control the electronic device 200 to control various services. For example, the processor 220 may decipher an instruction received from one or more other constituent elements (e.g., the memory 230, the speaker 240, the microphone 250, the communication module 260, the display module 270, and the input module 280) included in the electronic device 200 through the bus 210, and execute operation or data processing according to the deciphered instruction.

The processor 220 may control a microphone sensitivity of the hearing aid 220. For example, if sensing the occurrence of an event for microphone sensitivity control, the processor 220 may transmit a microphone sensitivity control signal for decreasing the microphone sensitivity of a hearing aid 202 to the hearing aid 202 through the communication module 260. For instance, if communication is performed with the hearing aid 202 through the communication module 260, the processor 220 may transmit the microphone sensitivity control signal for decreasing the microphone sensitivity of the hearing aid 202 to the hearing aid 202 through the communication module 260. The processor 220 may transmit a sound signal collected through the microphone 250 or a sound signal collected through a peripheral device, to the hearing aid 202 through the communication module 260.

Furthermore, for example, if sensing the occurrence of an event (e.g., a telephony event) with a counterpart electronic device, the processor 220 can transmit a microphone sensitivity control signal for decreasing a microphone sensitivity of the hearing aid 202 to the hearing aid 202 through the communication module 260. The processor 220 may transmit a reception signal (e.g., a call reception signal) provided from the counterpart electronic device through the communication module 260, to the hearing aid 202 through the communication module 260. Here, the event with the counterpart electronic device may further include a sound information sharing event.

The processor 220 may transmit a microphone sensitivity restoration signal for restoring a microphone sensitivity of the hearing aid 202, to the hearing aid 202 through the communication module 260. For example, if sensing the occurrence of an event for microphone sensitivity restoration, the processor 220 may transmit the microphone sensitivity restoration signal for restoring the microphone sensitivity of the hearing aid 202 to the hearing aid 202 through the communication module 260. For instance, if an event service (e.g., a telephony service) with a counterpart electronic device is provided using a peripheral device (e.g., a wearable device), the processor 220 may transmit the microphone sensitivity restoration signal for restoring the microphone sensitivity of the hearing aid 202 to the hearing aid 202 through the communication module 260. Furthermore, if the event service (e.g., the telephony service) with the counterpart electronic device has ended, the processor 220 may transmit the microphone sensitivity restoration signal for restoring the microphone sensitivity of the hearing aid 202 to the hearing aid 202 through the communication module 260.

When the electronic device 200 transmits a signal (e.g., a call reception signal) for an event service with a counterpart electronic device to the hearing aid 202, the processor 220 may transmit a sound signal collected through the microphone 250 of the electronic device 200 to the hearing aid 202, together with the call reception signal. For example, if sensing a user's danger signal through the sound signal collected through the microphone 250 of the electronic device 200, the processor 220 may transmit a danger sensing signal to the hearing aid 202 together with the call reception signal.

Furthermore, for example, the processor 220 may separate the sound signal collected through the microphone 250 of the electronic device 200 into a surrounding sound and a user voice. The processor 220 may transmit the user voice to the counterpart electronic device through the communication module 260, and transmit the surrounding sound to the hearing aid 202, together with the call reception signal.

The memory 230 may store an instruction or data received from one or more constituent elements (i.e., the processor 220, the speaker 240, the microphone 250, the communication module 260, the display module 270, and the input module 280) included in the electronic device 200, and/or generated by the one or more constituent elements.

The speaker 240 may output an audio signal provided from the processor 220, to a user. For example, when the processor 220 transmits to the hearing aid 202 a sound signal collected through the microphone 250 or a call reception signal provided from the counterpart electronic device through the communication module 260, the speaker 240 may be inactivated and/or activated in accordance to a control of the processor 220.

The microphone 250 may collect an external sound, and convert the external sound into an electrical audio signal, and provide the audio signal to the processor 220.

The communication module (i.e., the communication interface) 260 may communicate, via a network 208, between at least one hearing aid 202 and/or at least one other electronic device 204 and/or a server 206 and/or at least one peripheral device, and the electronic device 200. For example, the communication module 260 may communicate with at least one hearing aid 202 based on tag information provided through an electronic tag of the hearing aid 202. For instance, the communication module 260 may collect tag information of a hearing aid from an electronic tag inserted into the hearing aid or existing in a place separate from the hearing aid such as a product box of the hearing aid or a retailer thereof. Here, the tag information of the hearing aid may include one or more of identification information of the hearing aid or communication link setting information of the hearing aid.

The communication module 260 may support a short-range communication protocol (e.g., WiFi, Bluetooth, ZigBee, or NFC), a network communication protocol (e.g., the Internet, a Local Area Network (LAN), a Wireless Area Network (WAN), a telecommunication network, a cellular network, a satellite network and/or a Plain Old Telephone Service (POTS)), and/or a wired communication protocol (e.g., a Universal Serial Bus (USB), a High Definition Multimedia Interface (HDMI)). Here, the communication protocol (e.g., the short-range communication protocol, the network communication protocol, and/or the wired communication protocol) may be supported in a middleware of the memory 230 and/or an Application Programming Interface (API). Here, the other electronic device 204 being a peripheral device of the electronic device 200 may be the same-type device as the electronic device 200 or may include a different-type device.

The display module (i.e., a display) 270 may display an image, a video and/or data to a user.

The input module (i.e., an input interface) 280 may transmit an instruction and/or data generated by user's selection, to the processor 220 and/or the memory 230 through the bus 210. For example, the input module 280 may include one or more of a keypad including at least one hardware button, and a touch panel sensing touch information.

In the aforementioned embodiment, the electronic device 200 may transmit a sound signal or call reception signal collected through the microphone 250, to the hearing aid 202. Accordingly, the electronic device 200 may perform digital signal processing such as noise removal for the sound signal and/or call reception signal, and transmit the processed sound signal and/or call reception signal to the hearing aid 202.

According to various embodiments of the present disclosure, the electronic device 200 may be comprised of the microphone 250, the speaker 240, and the communication module 260. The electronic device 200 may include the processor 220 for transmitting a control signal for controlling a microphone sensitivity of the hearing aid 202, to the hearing aid 202 through the communication module 260, and transmitting a reception signal provided from a counterpart electronic device (e.g., the electronic device 204) to the hearing aid 202 through the communication module 260.

In an embodiment of the present disclosure, the communication module 260 may communicate with the hearing aid 202 using a short-range communication method.

In an embodiment of the present disclosure, the short-range communication method may include one or more of WiFi, Bluetooth, and/or NFC.

In an embodiment of the present disclosure, the communication module 260 may communicate with the hearing aid 202 in a BLE protocol communication method of deforming one or more of a data transmission interval and/or a data transmission duration.

In an embodiment of the present disclosure, the processor 220 may transmit at least a portion of a sound signal collected through the microphone 250 of the electronic device to the hearing aid 202 through the communication module 260.

In an embodiment of the present disclosure, the processor 220 may separate the sound signal collected through the microphone 250 of the electronic device 200 into a surrounding sound and a user voice, and transmit the surrounding sound to the hearing aid 202 through the communication module 260.

In an embodiment of the present disclosure, the processor 220 may check a user's danger occurrence and/or non-occurrence using the sound signal collected through the microphone 250 of the electronic device 200 and, if sensing the user's danger occurrence, may transmit a danger signal to the hearing aid 202 through the communication module 260.

In an embodiment of the present disclosure, if an event for microphone sensitivity restoration takes place, the processor 220 may transmit a control signal for restoring the microphone sensitivity of the hearing aid 202, to the hearing aid 202, through the communication module 260.

In an embodiment of the present disclosure, if an event with the counterpart electronic device (e.g., electronic device 204) has ended, the processor 220 may transmit the control signal for restoring the microphone sensitivity of the hearing aid 202, to the hearing aid 202, through the communication module 260.

In an embodiment of the present disclosure, if providing an event service with the counterpart electronic device (e.g., electronic device 204) using a peripheral device, the processor 220 may transmit the control signal for restoring the microphone sensitivity of the hearing aid 202, to the hearing aid 202, through the communication module 260.

In an embodiment of the present disclosure, if transmitting the control signal for restoring the microphone sensitivity of the hearing aid 202, to the hearing aid 202, the processor 220 may inactivate the speaker 240 of the electronic device 200.

In an embodiment of the present disclosure, if a telephony event with the counterpart electronic device (e.g., electronic device 204) takes place, the processor 220 may transmit the control signal for controlling the microphone sensitivity of the hearing aid 202, to the hearing aid 202, through the communication module 260.

According to various embodiments of the present disclosure, the electronic device 200 may be comprised of the microphone 250, the speaker 240, and the communication module 260. The electronic device 200 may include the processor 220 for transmitting a control signal for controlling a microphone sensitivity of the hearing aid 202, to the hearing aid 202, through the communication module 260, and for transmitting a sound signal collected through the microphone 250 of the electronic device 200 to the hearing aid 202.

In an embodiment of the present disclosure, the communication module 260 may collect electronic tag information of the hearing aid 202, and may communicate with the hearing aid 202 based on the electronic tag information.

Figure 3:
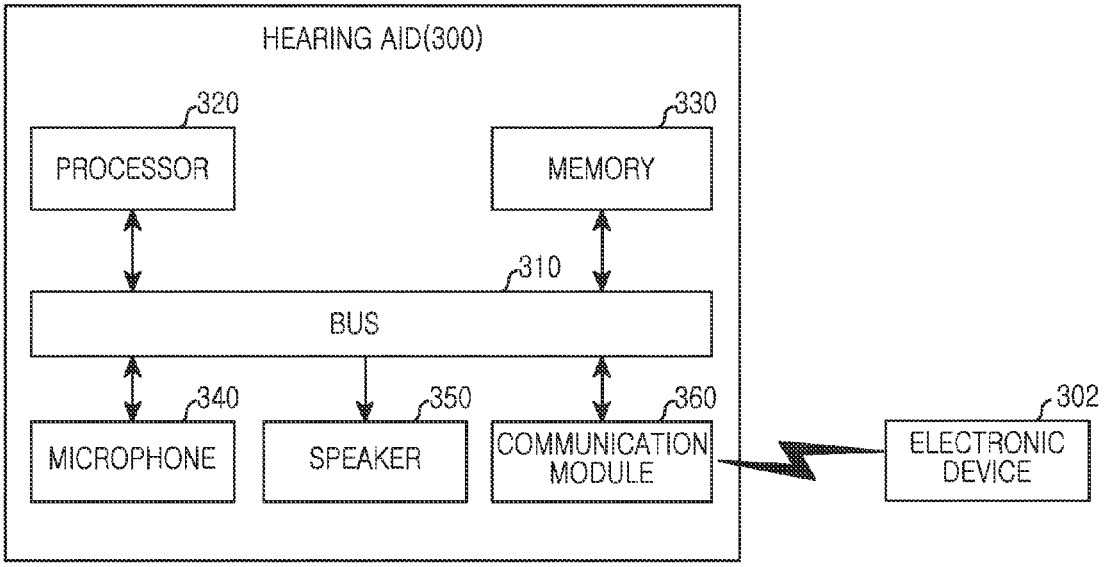
FIG. 3 illustrates a block diagram of a hearing aid according to an embodiment of the present disclosure.

FIG. 3 illustrates a block diagram of a hearing aid according to an embodiment of the present disclosure.

Referring to FIG. 3, a hearing aid 300 is illustrated, where the hearing aid 300 may include a bus 310, a processor 320, a memory 330, a microphone 340, a speaker 350, and/or a communication module (i.e., communication interface) 360. Here, the speaker 350 may include a receiver.

The bus 310 may connect the constituent elements included in the hearing aid 300 with one another, and control communication between the constituent elements included in the hearing aid 300.

The processor 320 may control to amplify a sound signal collected through the microphone 340 and an audio signal provided from an electronic device 302 through the communication module 360, and output the amplified signals through the speaker 350. For example, when operating in a general mode, the processor 320 may convert an audio signal provided from the microphone 340 into a digital sound signal. The processor 320 may perform digital signal processing such as noise removal, amplification gain, and non-linear amplification for the digital sound signal.

For instance, the processor 320 may control the speaker 350 to amplify the digital sound signal based on a preset amplification gain, and output the amplified sound signal. If the hearing aid 300 includes a hardware amplifier (not shown), the hardware amplifier may amplify the digital sound signal based on the control of the processor 320. The processor 320 may convert the processed digital sound signal into an analog signal and output the analog signal through the speaker 350.

Furthermore, for example, if a microphone sensitivity control signal is received from the electronic device 302 through the communication module 360, the processor 320 may decrease a sensitivity of the microphone 340 based on the microphone sensitivity control signal. For instance, the processor 320 may control the sensitivity of the microphone 340 and inactivate the microphone 340. If inactivating the microphone 340, the processor 320 may control to amplify an audio signal provided from the electronic device 302 through the communication module 360, and output the amplified audio signal to the speaker 350.

If decreasing the sensitivity of the microphone 340, the processor 320 may restore the decreased sensitivity of the microphone 340 to the original sensitivity based on the occurrence of an event for microphone sensitivity restoration. For example, if receiving a microphone sensitivity restoration signal from the electronic device 302 through the communication module 360, the processor 320 may restore the decreased sensitivity of the microphone 340 to the original sensitivity.

Furthermore, for example, if an event (e.g., communication) with the electronic device 302 has ended or has been paused, the processor 320 may restore the decreased sensitivity of the microphone 340 to the original sensitivity.

If restoring the sensitivity of the microphone 304, the processor 320 may control to amplify a sound signal collected through the microphone 340, and output the amplified sound signal through the speaker 350.

The memory 330 may store control data for controlling one or more constituent elements (i.e., the processor 320, the microphone 340, the speaker 350, and the communication module 360) included in the hearing aid 300. For example, the memory 330 may store amplification gain information for amplification of a sound signal.

The microphone 340 may collect an external sound, and convert the collected sound into an electrical audio signal, and output the audio signal. For example, the microphone 340 may include a plurality of microphones, and may collect a sound of an audible frequency band or preset specific frequency band, and convert the collected sound into an electrical audio signal, and output the audio signal. Additionally, the microphone 340 may include a filter for filtering an audio signal and/or extracting a signal of an audible band based on a characteristic of a hearing sense of a user who wears the hearing aid 300.

The speaker 350 may output a sound signal provided from the processor 320. For example, the speaker 350 may amplify an analog sound signal based on an amplification gain that is set in the processor 320, and output the amplified sound signal.

Figure 4:
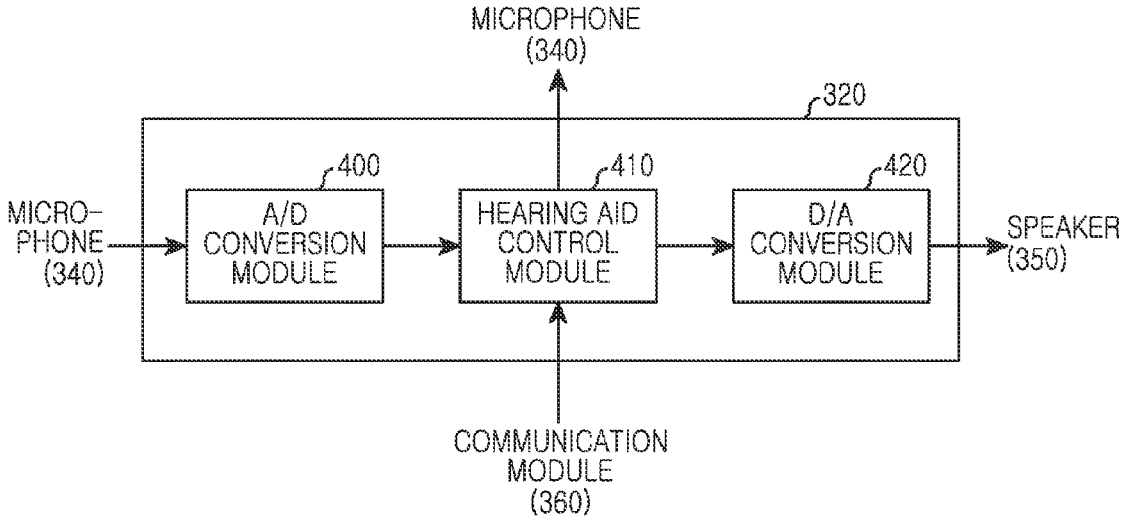
FIG. 4 illustrates a detailed block diagram of a processor of a hearing aid according to an embodiment of the present disclosure.

FIG. 4 illustrates a detailed block diagram of a processor of a hearing aid according to an embodiment of the present disclosure.

Referring to FIG. 4, a processor 320 is illustrated, where the processor 320 may include an Analog/Digital (A/D) conversion module 400, a hearing aid control module 410, and a Digital/Analog (D/A) conversion module 420.

The A/D conversion module 400 may convert an audio signal provided from the microphone 340, as illustrated in FIG. 3, into a digital sound signal.

The hearing aid control module 410 may control to amplify a digital sound signal provided from the A/D conversion module 400 and/or an audio signal provided from the electronic device 302 through the communication module 360, as illustrated in FIG. 3, and may output the amplified signals through the speaker 350, as illustrated in FIG. 3. If operating in a general mode, the hearing aid control module 410 may perform digital signal processing such as noise removal, amplification gain, and non-linear amplification for the digital sound signal provided from the A/D conversion module 400.

Furthermore, for example, if receiving a microphone sensitivity control signal from the electronic device 302 through the communication module 360, the processor 320 may decrease a sensitivity of the microphone 340 based on the microphone sensitivity control signal. For instance, the processor 320 may control the sensitivity of the microphone 340 and inactivate the microphone 340. If inactivating the microphone 340, the processor 320 may control to amplify an audio signal provided from the electronic device 302 through the communication module 360, and output the amplified audio signal to the speaker 350.

If decreasing the sensitivity of the microphone 340, the processor 320 may restore the decreased sensitivity of the microphone 340 to the original sensitivity based on the occurrence of an event for microphone sensitivity restoration. For example, if receiving a microphone sensitivity restoration signal from the electronic device 302 through the communication module 360, the processor 320 may restore the decreased sensitivity of the microphone 340 to the original sensitivity. Furthermore, for example, if an event (e.g., communication) with the electronic device 302 has ended or has been paused, the processor 320 may restore the decreased sensitivity of the microphone 340 to the original sensitivity.

The D/A conversion module 420 may convert the digital sound signal digital-signal-processed in the hearing aid control module 410 into an analog signal, and output the analog signal through the speaker 350.

According to various embodiments of the present disclosure, the hearing aid 300, as illustrated in FIG. 3, may include at least one microphone 340, the speaker 350, the communication module 360, and the processor 320 for controlling a microphone sensitivity of the hearing aid based on a control signal provided from the electronic device 302, as illustrated in FIG. 3, amplifying a sound signal provided from the electronic device through the communication module 360 and outputting the amplified sound signal to the speaker 350 of the hearing aid 300.

In an embodiment of the present disclosure, the processor 320 may control the microphone sensitivity such that the microphone 340 of the hearing aid 300 is inactivated, based on the control signal provided from the electronic device 302.

In an embodiment of the present disclosure, if an event with the electronic device 302 has ended or has been paused, the processor 320 may restore the microphone sensitivity of the hearing aid 300, amplify a sound signal collected through the microphone 340 of the hearing aid 300 and output the amplified sound signal through the speaker 3350 of the hearing aid 300.

In an embodiment of the present disclosure, if a control signal for restoring the microphone sensitivity of the hearing aid 300 is received from the electronic device 302 through the communication module 360, the processor 320 may restore the microphone sensitivity of the hearing aid 300, amplify a sound signal collected through the microphone 340 of the hearing aid 300 and output the amplified sound signal through the speaker 350 of the hearing aid 300.

Figure 5:
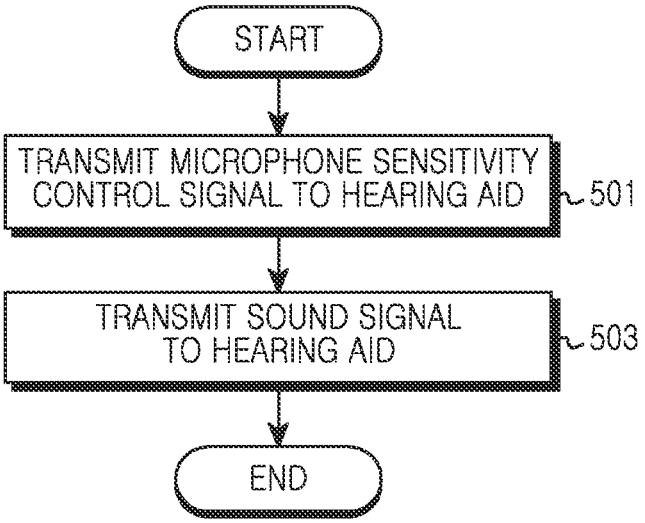
FIG. 5 illustrates a procedure for controlling a microphone sensitivity of a hearing aid in an electronic device according to an embodiment of the present disclosure.

FIG. 5 illustrates a procedure for controlling a microphone sensitivity of a hearing aid in an electronic device according to an embodiment of the present disclosure.

Referring to FIG. 5, a procedure is illustrated, such that in operation 501, an electronic device may transmit a microphone sensitivity control signal to a hearing aid. For example, the electronic device may transmit the microphone sensitivity control signal to the hearing aid, using a BLE protocol communication method. The electronic device may deform a data transmission interval and a data transmission duration being defined in the BLE protocol such that transmission of a sound signal is possible.

In operation 503, the electronic device may transmit a sound signal collected through a microphone of the electronic device, to the hearing aid. For example, the electronic device 200, as illustrated in FIG. 2, may perform digital signal processing such as noise removal for a sound signal collected through the microphone 250, as illustrated in FIG. 2, and transmit the processed sound signal to the hearing aid 202, as illustrated in FIG. 2.

Figure 6:
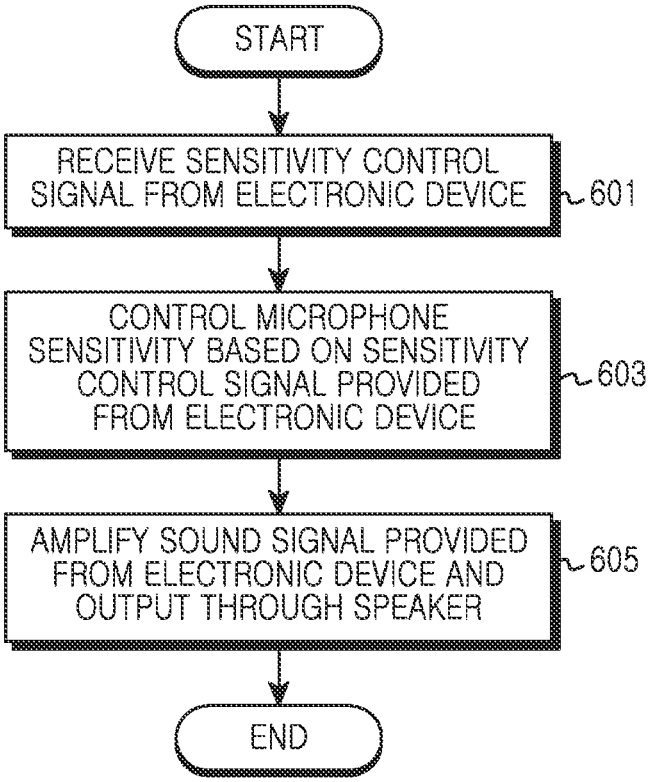
FIG. 6 illustrates a procedure for controlling a microphone sensitivity in a hearing aid according to an embodiment of the present disclosure.

FIG. 6 illustrates a procedure for controlling a microphone sensitivity in a hearing aid according to an embodiment of the present disclosure.

Referring to FIG. 6, a procedure is illustrated, such that in operation 601, a hearing aid may receive a microphone sensitivity control signal from an electronic device.

In operation 603, the hearing aid may decrease a sensitivity of a microphone of the hearing aid based on the microphone sensitivity control signal received from the electronic device. For example, the hearing aid 300, as illustrated in FIG. 3, may control a microphone sensitivity such that the microphone 340, as illustrated in FIG. 3, is inactivated, based on the microphone sensitivity control signal.

In operation 605, the hearing aid may amplify a sound signal provided from the electronic device, and output the amplified sound signal through a speaker of the hearing aid.

Figure 7:
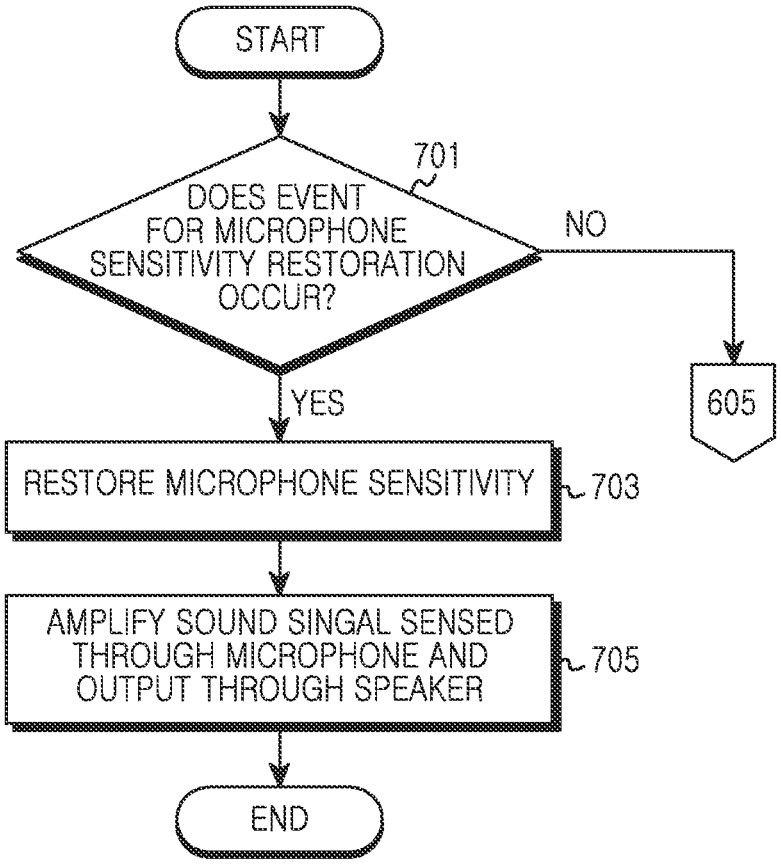
FIG. 7 illustrates a procedure for restoring a microphone sensitivity in a hearing aid according to an embodiment of the present disclosure.

FIG. 7 illustrates a procedure for restoring a microphone sensitivity in a hearing aid according to an embodiment of the present disclosure.

Referring to FIG. 7, a procedure is illustrated, such that if amplifying a sound signal provided from an electronic device and if outputting the amplified sound signal through the speaker of the hearing aid is performed, as in operation 605 of FIG. 6, in operation 701, the hearing aid may sense if an event for microphone sensitivity restoration occurs. For example, if an event (e.g., communication) with the electronic device has ended or has been paused, the hearing aid may recognize that the event for microphone sensitivity restoration takes place. Furthermore, for example, if a control signal for microphone sensitivity restoration is received from the electronic device, the hearing aid may recognize that the event for microphone sensitivity restoration takes place.

If the event for microphone sensitivity restoration does not take place in operation 701, the hearing aid may proceed to operation 605 of FIG. 6 to amplify a sound signal provided from the electronic device, and to output the amplified sound signal through the speaker of the hearing aid.

If the event for microphone sensitivity restoration takes place in operation 701, then in operation 703, the hearing aid may restore a sensitivity of a microphone of the hearing aid. For example, the hearing aid 300 may control the microphone sensitivity such that the microphone 340 is activated.

In operation 705, the hearing aid may amplify a sound signal collected through the microphone of the hearing aid based on the restored sensitivity of the microphone of the hearing aid, and may output the amplified sound signal through the speaker of the hearing aid.

Figure 8:
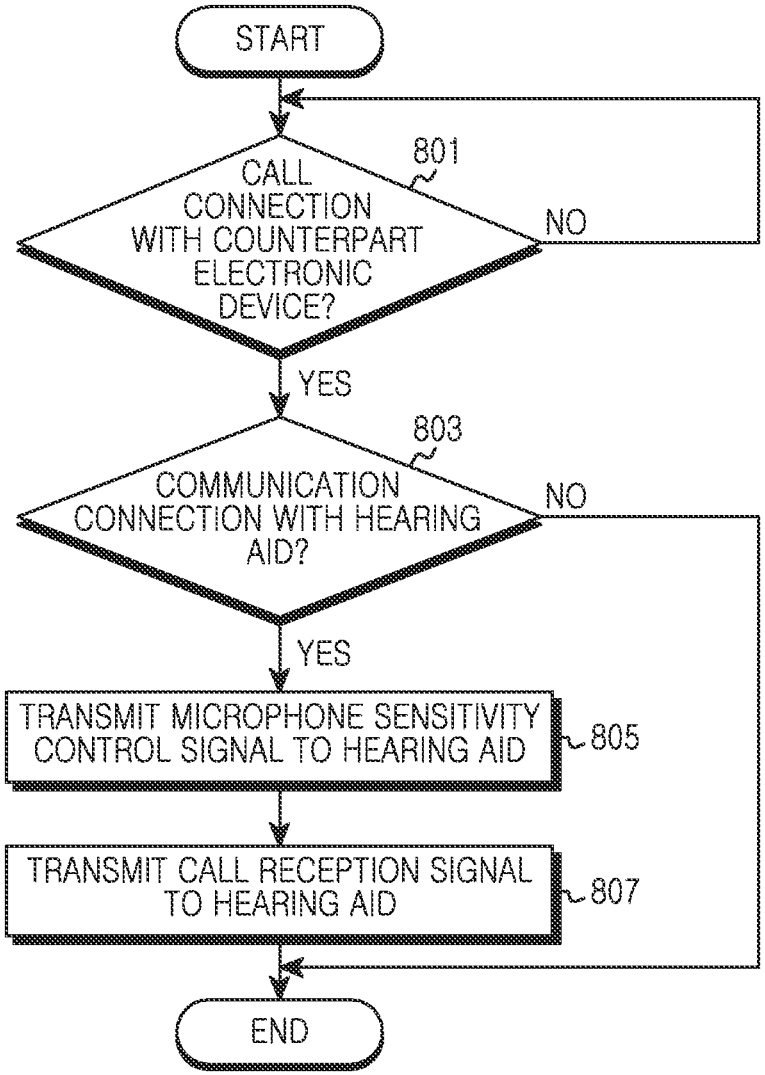
FIG. 8 illustrates a procedure for, upon call connection, controlling a microphone sensitivity of a hearing aid in an electronic device according to an embodiment of the present disclosure.

FIG. 8 illustrates a procedure for, upon call connection, controlling a microphone sensitivity of a hearing aid in an electronic device according to an embodiment of the present disclosure.

Referring to FIG. 8, a procedure is illustrated, such that in operation 801, an electronic device may check if an event service (e.g., a telephony service) with a counterpart electronic device is provided. For example, the electronic device 200, as illustrated in FIG. 2, may receive a call from the counterpart electronic device 204, as illustrated in FIG. 2, and check if a call with the counterpart electronic device 204 is connected. Furthermore, for example, the electronic device 200 may perform a call connection with the counterpart electronic device based on input information detected through the input module 280, as illustrated in FIG. 2.

If the event service (e.g., telephony service) with the counterpart electronic device is not connected in operation 801, the electronic device may return to operation 801 and again check if the event service (e.g., telephony service) with the counterpart electronic device is connected.

If the event service (e.g., telephony service) with the counterpart electronic device is connected in operation 801, the electronic device may proceed to operation 803 and check if communication with the hearing aid is connected. For instance, the electronic device may check a communication state with the hearing aid.

If the communication with the hearing aid is not connected in operation 803, the electronic device may terminate the present algorithm. For example, the electronic device 200 may provide a telephony service with the counterpart electronic device using the speaker 240 and the microphone 250, as illustrated in FIG. 2.

If the communication with the hearing aid is connected in operation 803, then in operation 805, the electronic device may transmit a microphone sensitivity control signal to the hearing aid.

In operation 807, the electronic device may transmit a call reception signal provided from the counterpart electronic device, to the hearing aid. For example, the electronic device 200 may perform digital signal processing such as noise removal for the call reception signal provided from the counterpart electronic device through the communication module 260, as illustrated in FIG. 2, and transmit the processed call reception signal to the hearing aid 202, as illustrated in FIG. 2.

Figure 9:
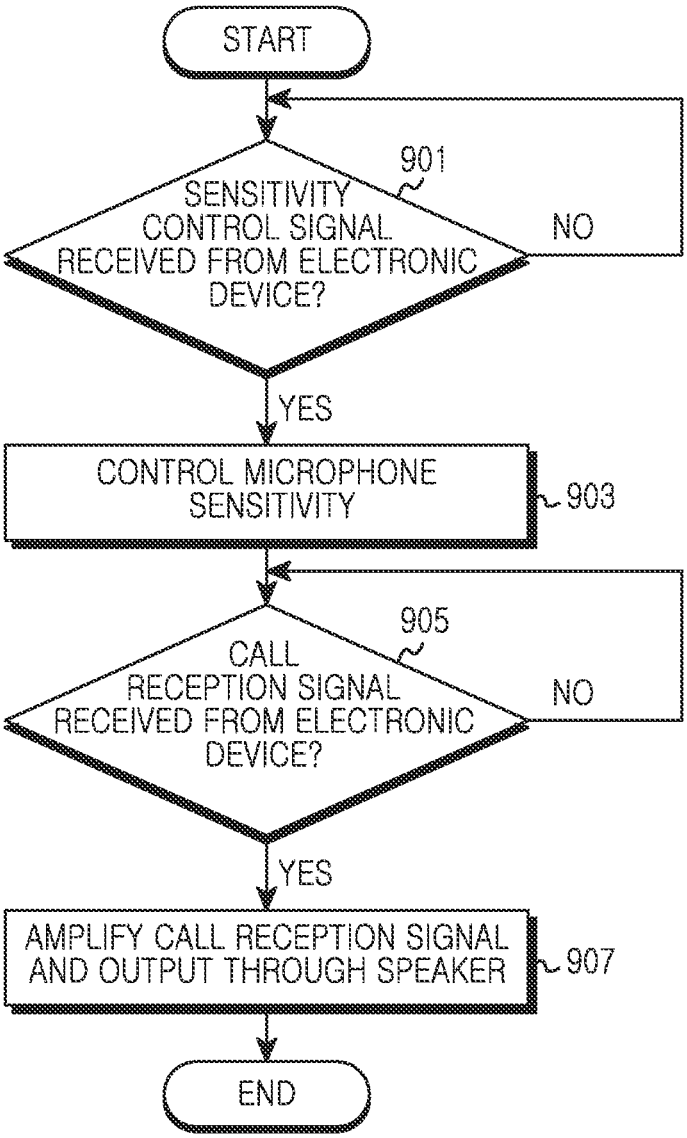
FIG. 9 illustrates a procedure for controlling a microphone sensitivity based on control of an electronic device in a hearing aid according to an embodiment of the present disclosure.

FIG. 9 illustrates a procedure for controlling a microphone sensitivity based on control of an electronic device in a hearing aid according to an embodiment of the present disclosure.

Referring to FIG. 9, a procedure is illustrated, such that in operation 901, a hearing aid may check if a microphone sensitivity control signal is received from an electronic device.

If the microphone sensitivity control signal is not received from the electronic device in operation 901, the hearing aid may return to operation 901 and again check if the microphone sensitivity control signal is received from the electronic device. The hearing aid may amplify a sound signal collected through a microphone of the hearing aid based on a preset microphone sensitivity, and output the amplified sound signal through a speaker of the hearing aid.

If the microphone sensitivity control signal is received from the electronic device in operation 901, the hearing aid may proceed to operation 903 and decrease a sensitivity of the microphone of the hearing aid based on the microphone sensitivity control signal provided from the electronic device. For example, the hearing aid 300, as illustrated in FIG. 3, may control the microphone sensitivity such that the microphone 340, as illustrated in FIG. 3, is inactivated, based on the microphone sensitivity control signal.

In operation 905, the hearing aid may check if a call reception signal is received from the electronic device.

If the call reception signal is not received from the electronic device in operation 905, the hearing aid may return to operation 905 and again check if the call reception signal is received from the electronic device. If the call reception signal is not received during a valid time after controlling the sensitivity of the microphone, the hearing aid may restore the microphone sensitivity to the original sensitivity, amplify a sound signal collected through the microphone of the hearing aid, and output the amplified sound signal through the speaker of the hearing aid.

If the call reception signal is received from the electronic device in operation 905, the hearing aid may proceed to operation 907 to amplify the received call reception signal and to output the amplified call reception signal through the speaker of the hearing aid.

Figure 10:
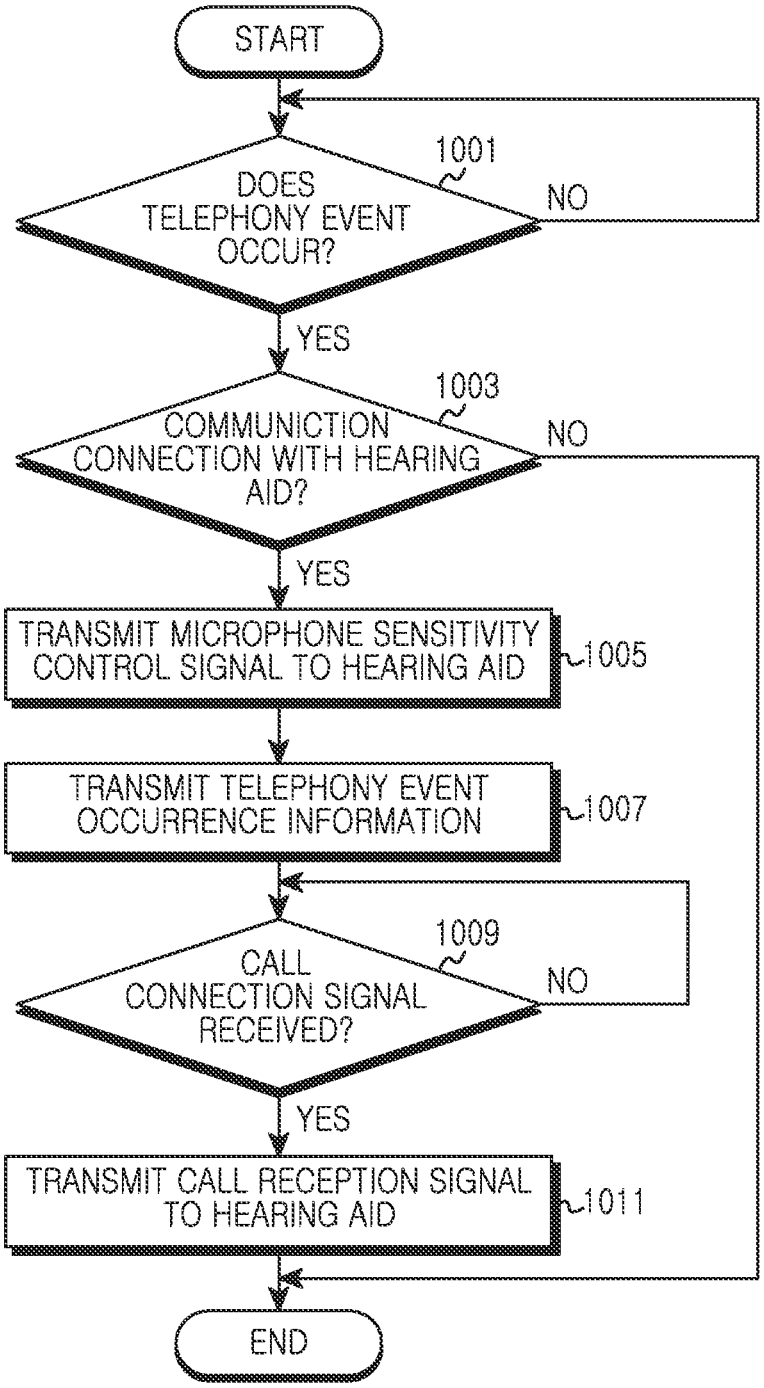
FIG. 10 illustrates a procedure for, upon call connection, controlling a microphone sensitivity of a hearing aid in an electronic device according to an embodiment of the present disclosure.

FIG. 10 illustrates a procedure for, upon call connection, controlling a microphone sensitivity of a hearing aid in an electronic device according to an embodiment of the present disclosure.

Referring to FIG. 10, a procedure is illustrated, such that in operation 1001, the electronic device may check if a telephony event takes place. For example, the electronic device 200, as illustrated in FIG. 2, may check if a call is received from the counterpart electronic device 204, as illustrated in FIG. 2.

If the telephony event does not take place in operation 1001, the electronic device may return to operation 1001 and again check if the telephony event takes place.

If the telephony event occurs in operation 1001, the electronic device may go to operation 1003 and check if communication with the hearing aid is connected.

If the communication with the hearing aid is not connected in operation 1003, the electronic device may terminate the present algorithm. For example, the electronic device 200 may provide a telephony service with the counterpart electronic device 204 using the speaker 240 and the microphone 250, as illustrated in FIG. 2.

If the communication with the hearing aid is connected in operation 1003, the electronic device may proceed to operation 1005 and transmit a microphone sensitivity control signal to the hearing aid.

In operation 1007, the electronic device may transmit telephony event occurrence information to the hearing aid.

In operation 1009, the electronic device may check if a call connection signal is received from the hearing aid.

If the call connection signal is not received from the hearing aid in operation 1009, the electronic device may return to operation 1009 and again check if the call connection signal is received from the hearing aid. If the call connection signal is not received during a valid time after transmitting the telephony event occurrence information, the electronic device may recognize that the call connection fails, and terminate the present algorithm.

If the call connection signal is received from the hearing aid in operation 1009, the electronic device may proceed to operation 1011 and connect a call with the counterpart electronic device and transmit, to the hearing aid, a call reception signal provided from the counterpart electronic device. For example, the electronic device 200 may perform digital signal processing such as noise removal for the call reception signal provided from the counterpart electronic device through the communication module 260, as illustrated in FIG. 2, and transmit the processed call reception signal to the hearing aid 202, as illustrated in FIG. 2.

In the aforementioned embodiment, the electronic device may connect a call with the counterpart electronic device based on the call connection signal provided from the hearing aid.

In another embodiment, the electronic device may connect a call with the counterpart electronic device based on input information detected through the input module of the electronic device.

Figure 11:
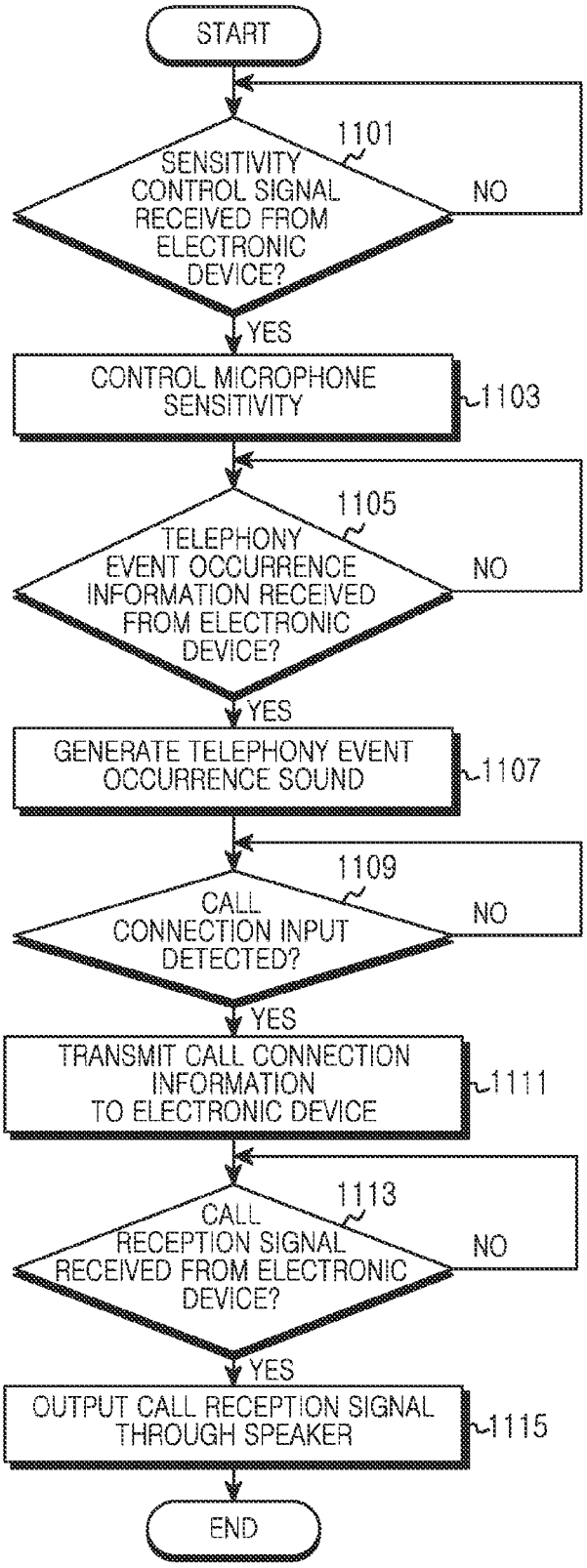
FIG. 11 illustrates a procedure for controlling a microphone sensitivity based on control of an electronic device in a hearing aid according to an embodiment of the present disclosure.

FIG. 11 illustrates a procedure for controlling a microphone sensitivity based on control of an electronic device in a hearing aid according to an embodiment of the present disclosure.

Referring to FIG. 11, a procedure is illustrated, such that in operation 1101, a hearing aid may check if a microphone sensitivity control signal is received from an electronic device.

If the microphone sensitivity control signal is not received from the electronic device in operation 1101, the hearing aid may return to operation 1101 and again check if the microphone sensitivity control signal is received from the electronic device. The hearing aid may amplify a sound signal collected through a microphone of the hearing aid based on a preset microphone sensitivity, and output the amplified sound signal through a speaker of the hearing aid.

If the microphone sensitivity control signal is received from the electronic device in operation 1101, the hearing aid may proceed to operation 1103 and control (e.g., decrease) a sensitivity of the microphone based on the microphone sensitivity control signal provided from the electronic device. For example, the hearing aid 300, as illustrated in FIG. 3, may control the microphone sensitivity such that the microphone 340, as illustrated in FIG. 3, is inactivated, based on the microphone sensitivity control signal.

In operation 1105, the hearing aid may check if telephony event occurrence information is received from the electronic device.

If the telephony event occurrence information is not received from the electronic device in operation 1105, the hearing aid may return to operation 1105 and again check if the telephony event occurrence information is received from the electronic device. If the telephony event occurrence information is not received during a valid time after controlling the sensitivity of the microphone, the hearing aid may restore the microphone sensitivity, amplify a sound signal collected through the microphone of the hearing aid, and output the amplified sound signal through the speaker of the hearing aid.

If the telephony event occurrence information is received from the electronic device in operation 1105, the hearing aid may proceed to operation 1107 and generate/output a telephony event occurrence sound through the speaker of the hearing aid.

In operation 1109, the hearing aid may check if a call connection input is detected. For example, the hearing aid 300, as illustrated in FIG. 3, may check if a user's input for call connection is detected through an input unit (not shown).

If the call connection input is not detected in operation 1109, the hearing aid may return to operation 1109 and again check if the call connection input is detected.

If the call connection input is detected in operation 1109, the hearing aid may proceed to operation 1111 and transmit call connection information including the call connection input, to the electronic device.

In operation 1113, the hearing aid may check if a call reception signal is received from the electronic device.

If the call reception signal is not received from the electronic device in operation 1113, the hearing aid may return to operation 1113 and again check if the call reception signal is received from the electronic device. If the call reception signal is not received during a valid time after transmitting the call connection information, the hearing aid may restore the microphone sensitivity, amplify a sound signal collected through the microphone of the hearing aid, and output the amplified sound signal through the speaker of the hearing aid.

If the call reception signal is received from the electronic device in operation 1113, then in operation 1115, the hearing aid may amplify the call reception signal and output the amplified call reception signal through the speaker of the hearing aid.

Figure 12:
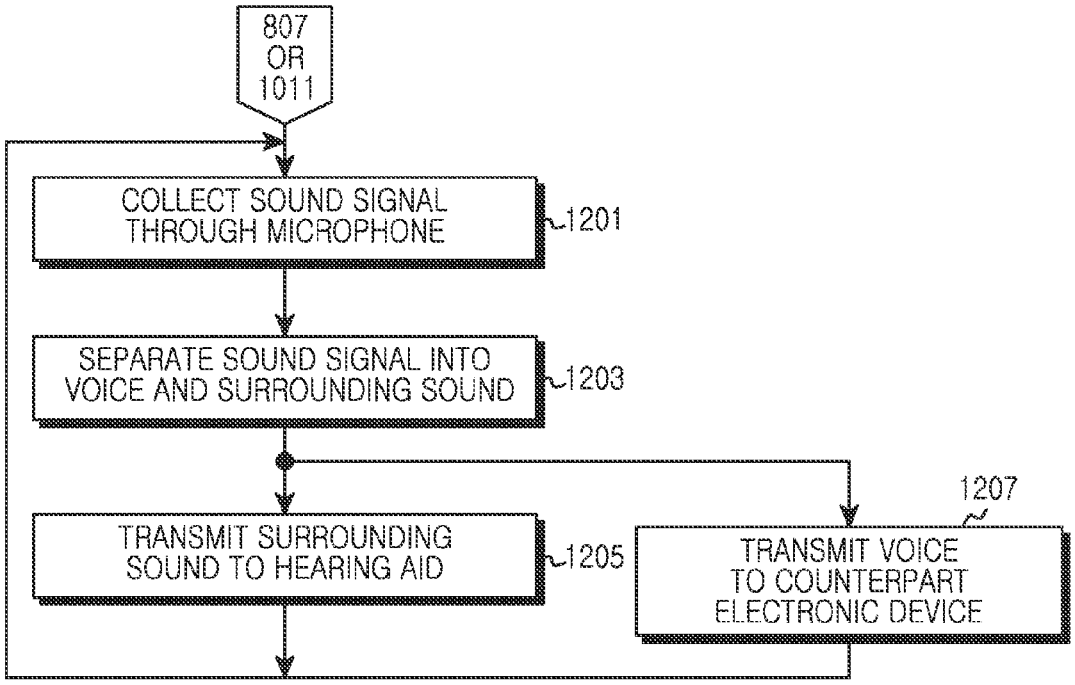
FIG. 12 illustrates a procedure for transmitting a sound signal collected through a microphone to a hearing aid in an electronic device according to an embodiment of the present disclosure.

FIG. 12 illustrates a procedure for transmitting a sound signal collected through a microphone to a hearing aid in an electronic device according to an embodiment of the present disclosure.

Referring to FIG. 12, a procedure is illustrated, such that when transmitting the call reception signal to the hearing aid in operation 807 of FIG. 8 or operation 1011 of FIG. 10, in operation 1201, the electronic device may collect a sound signal through a microphone of the electronic device.

After operation 1203, the electronic device may separate the sound signal collected through the microphone of the electronic device into a surrounding sound and a user voice.

After separating the sound signal into the surrounding sound and the user voice in operation 1203, the electronic device may also proceed to operation 1205 and transmit the surrounding sound to the hearing aid. For example, when a call reception signal to be transmitted to the hearing aid exists, the electronic device may transmit the surrounding sound to the hearing aid, together with the call reception signal.

If separating the sound signal into the surrounding sound and the user voice in operation 1203, the electronic device may proceed to operation 1207 and transmit the user voice to a counterpart electronic device providing a telephony service.

In the aforementioned embodiment, the electronic device may separate the surrounding sound among the sound signal collected through the microphone of the electronic device, and transmit the surrounding sound to the hearing aid.

In another embodiment, the electronic device may transmit the sound signal collected through the microphone of the electronic device to the hearing aid. For example, when a call reception signal to be transmitted to the hearing aid exists, the electronic device may transmit the sound signal collected through the microphone of the electronic device to the hearing aid, together with the call reception signal.

Figure 13:
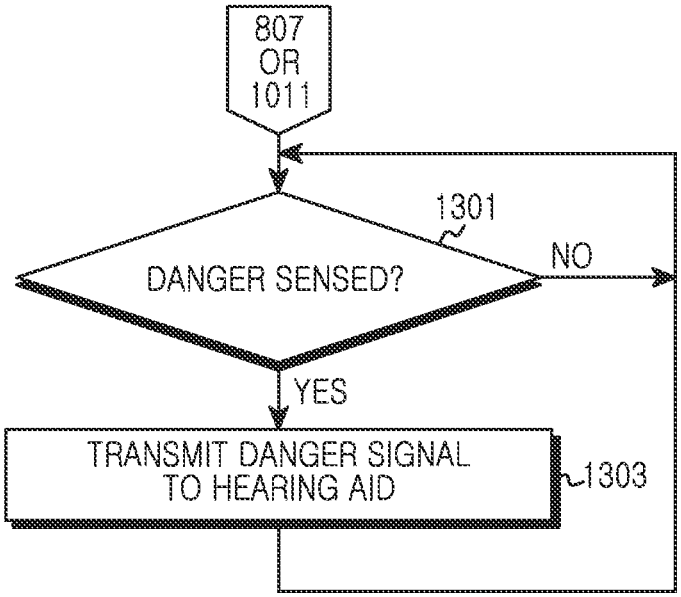
FIG. 13 illustrates a procedure for transmitting a danger sensing signal to a hearing aid in an electronic device according to an embodiment of the present disclosure.

FIG. 13 illustrates a procedure for transmitting a danger sensing signal to a hearing aid in an electronic device according to an embodiment of the present disclosure.

Referring to FIG. 13, a procedure is illustrated, such that when transmitting the call reception signal to the hearing aid in operation 807 of FIG. 8 or operation 1011 of FIG. 10, in operation 1301, the electronic device may check if a user's danger situation is sensed. For example, the electronic device 200, as illustrated in FIG. 2, may check if the user's danger situation is sensed based on a sound signal collected through the microphone 250, as illustrated in FIG. 2.

If the user's danger situation is not sensed in operation 1301, the electronic device may return to operation 1301 and again check if the user's danger situation is sensed.

If the danger situation is sensed in operation 1301, then in operation 1303, the electronic device may transmit a danger signal to the hearing aid. For example, when the call reception signal to be transmitted to the hearing aid exists, the electronic device may transmit the danger signal to the hearing aid, together with the call reception signal.

Figure 14:
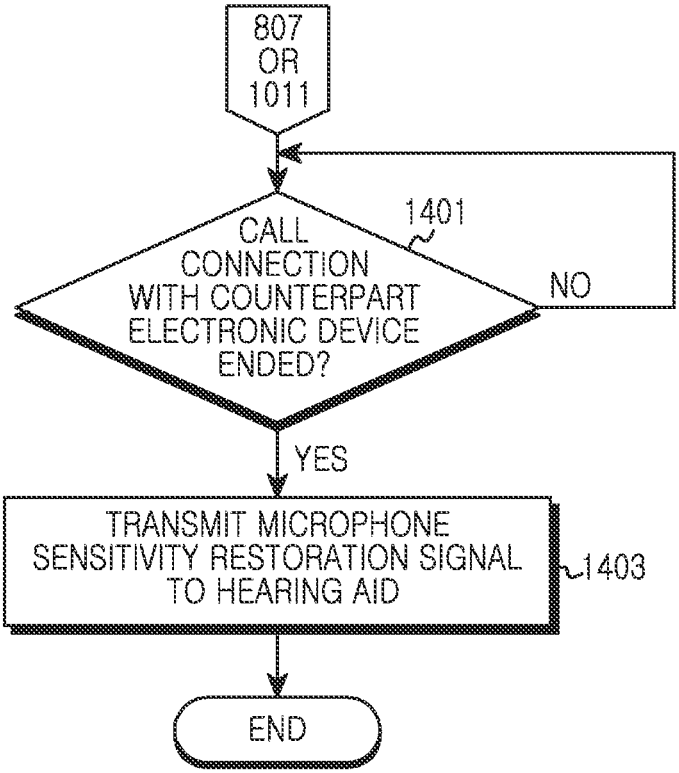
FIG. 14 illustrates a procedure for, upon call disconnection, controlling a microphone sensitivity of a hearing aid in an electronic device according to an embodiment of the present disclosure.

FIG. 14 illustrates a procedure for, upon call disconnection, controlling a microphone sensitivity of a hearing aid in an electronic device according to an embodiment of the present disclosure.

Referring to FIG. 14, a procedure is illustrated, such that when transmitting the call reception signal to the hearing aid in operation 807 of FIG. 8 or operation 1011 of FIG. 10, in operation 1401, the electronic device may check if a call connection with a counterpart electronic device has ended.

If the call connection with the counterpart electronic device has not ended in operation 1401, the electronic device may return to operation 1401 and again check if the call connection with the counterpart electronic device has ended.

If the call connection with the counterpart electronic device has ended in operation 1401, then in operation 1403, the electronic device may transmit a microphone sensitivity restoration signal for restoring a microphone sensitivity of the hearing aid, to the hearing aid.

Figure 15:
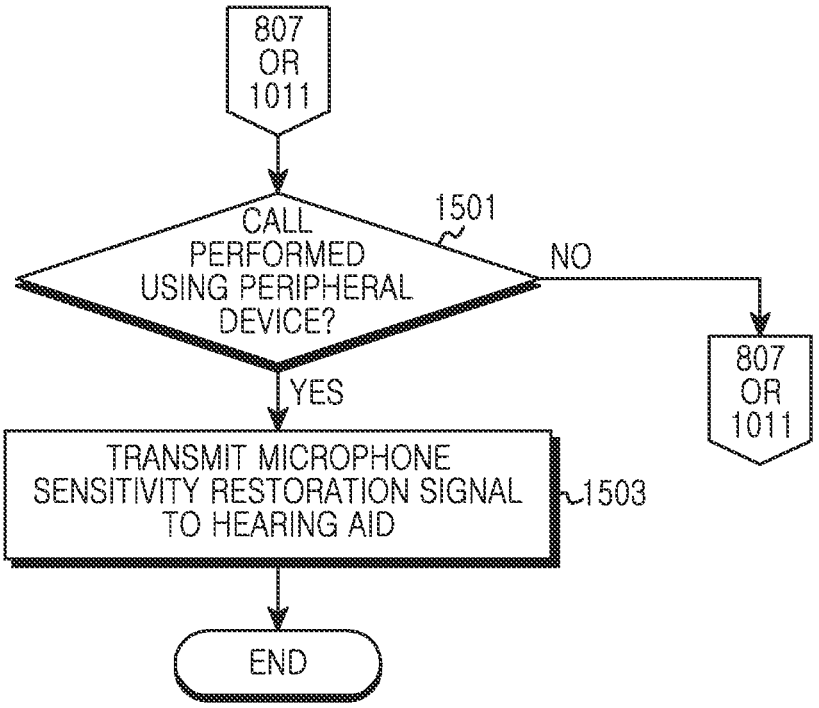
FIG. 15 illustrates a procedure for controlling a microphone sensitivity of a hearing aid based on connection or disconnection with a peripheral device in an electronic device according to an embodiment of the present disclosure.

FIG. 15 illustrates a procedure for controlling a microphone sensitivity of a hearing aid based on connection or disconnection with a peripheral device in an electronic device according to an embodiment of the present disclosure.

Referring to FIG. 15, a procedure is illustrated, such that when transmitting the call reception signal to the hearing aid in operation 807 of FIG. 8 or operation 1011 of FIG. 10, in operation 1501, the electronic device may check if it performs a call (e.g., telephony) with a counterpart electronic device using a peripheral device. For example, the electronic device may check if it performs telephony with the counterpart electronic device using a wearable device.

If the call is not performed with the counterpart electronic device using the peripheral device in operation 1501, the electronic device may transmit the call reception signal to the hearing aid in operation 807 of FIG. 8 or operation 1011 of FIG. 10.

If the call is performed with the counterpart electronic device using the peripheral device in operation 1501, then in operation 1503, the electronic device may transmit a microphone sensitivity restoration signal for restoring a microphone sensitivity of the hearing aid, to the hearing aid.

In the aforementioned embodiment, the electronic device may control the microphone sensitivity of the hearing aid, and check if it performs the call with the counterpart electronic device using the peripheral device during transmission of a call reception signal.

In another embodiment, the electronic device may check whether to perform the telephony with the counterpart electronic device using the peripheral device before controlling the microphone sensitivity of the hearing aid. For example, if the telephony event occurs in operation 1001 of FIG. 10, the electronic device may check whether to perform the telephony with the counterpart electronic device using the peripheral device. If not using the peripheral device, in operation 1003, the electronic device may check if the communication with the hearing aid has been connected.

Figure 16:
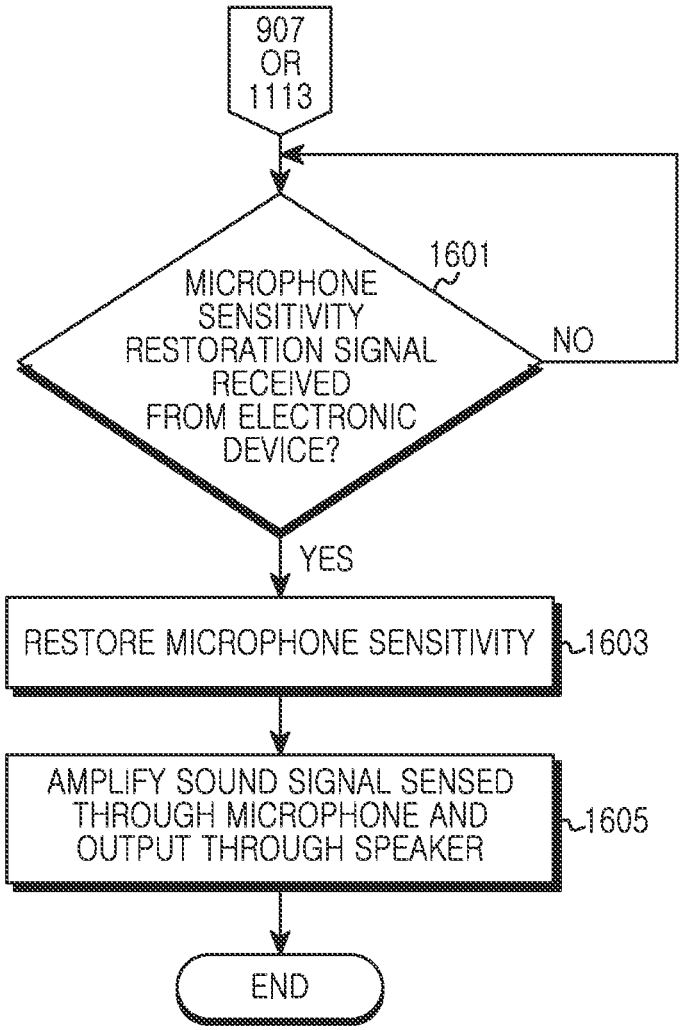
FIG. 16 illustrates a procedure for restoring a microphone sensitivity based on control of an electronic device in a hearing aid according to an embodiment of the present disclosure.

FIG. 16 illustrates a procedure for restoring a microphone sensitivity based on control of an electronic device in a hearing aid according to an embodiment of the present disclosure.

Referring to FIG. 16, a procedure is illustrated, such that when amplifying the call reception signal provided from the electronic device and outputting the amplified call reception signal through the speaker in operation 907 of FIG. 9 or operation 1113 of FIG. 11, in operation 1601, the hearing aid may check if a microphone sensitivity restoration signal is received from the electronic device.

If the microphone sensitivity restoration signal is not received from the electronic device in operation 1601, the hearing aid may return to operation 1601 and again check if the microphone sensitivity restoration signal is received from the electronic device. Accordingly, the hearing aid may amplify the call reception signal provided from the electronic device and output the amplified call reception signal through a speaker of the hearing aid.

If the microphone sensitivity restoration signal is received from the electronic device in operation 1601, then in operation 1603, the hearing aid may restore a microphone sensitivity based on the microphone sensitivity restoration signal. For example, the hearing aid 300, as illustrated in FIG. 3, may control the microphone sensitivity such that the microphone 340 is activated, as illustrated in FIG. 3.

In operation 1605, the hearing aid may amplify a sound signal collected through a microphone of the hearing aid based on the restored microphone sensitivity, and output the amplified sound signal through a speaker of the hearing aid.

In the aforementioned embodiment, the electronic device may transmit the sound signal collected through the microphone of the electronic device to the hearing aid. Accordingly, the electronic device may perform beamforming for the sound signal, and process the sound signal such that the sound signal is focused in a specific direction, and transmit the processed sound signal to the hearing aid.

Figure 17:
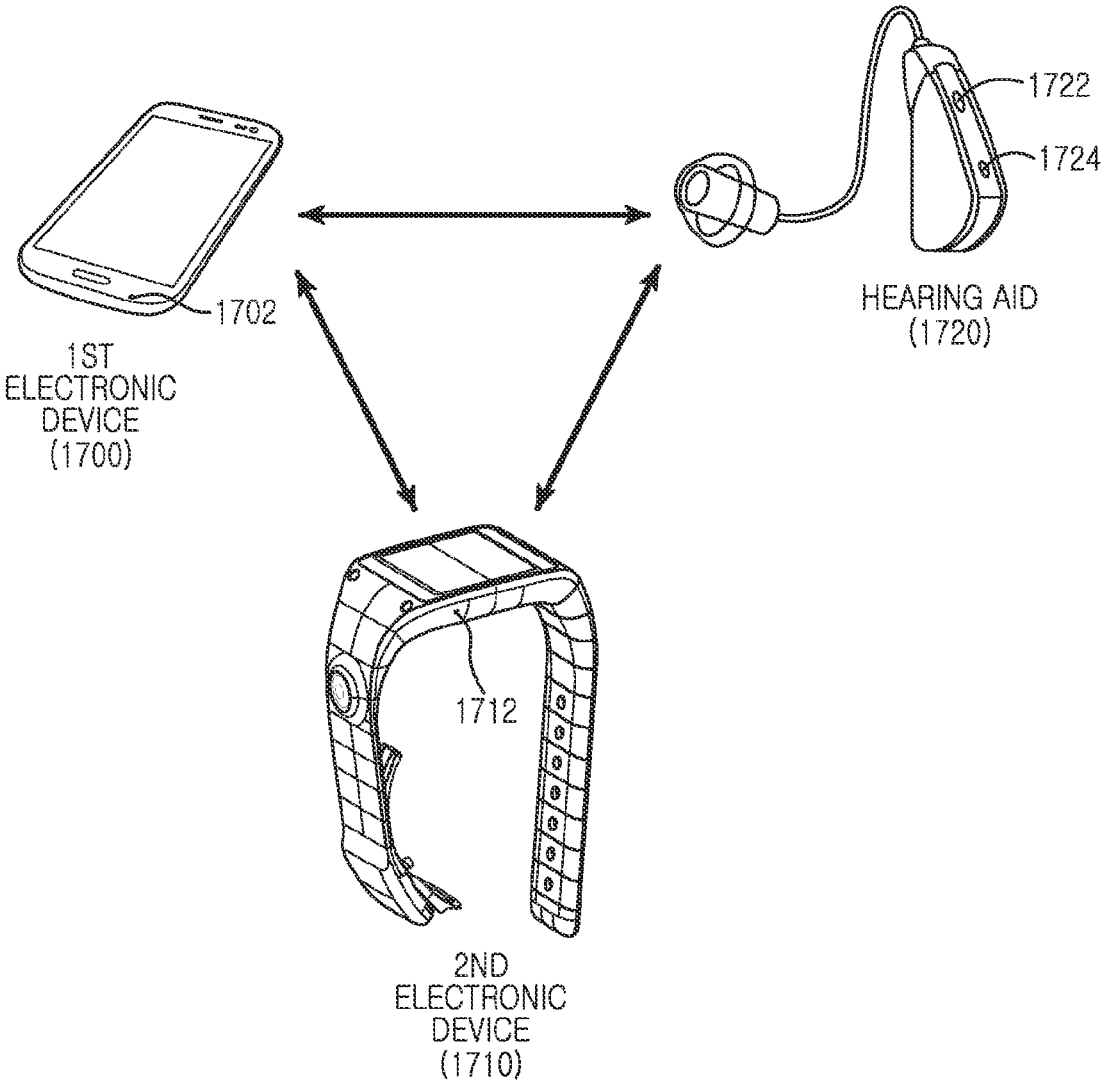
FIG. 17 illustrates a construction for collecting a sound signal according to an embodiment of the present disclosure.

FIG. 17 illustrates a construction for collecting a sound signal according to an embodiment of the present disclosure.

Referring to FIG. 17, a $1^{st}$ electronic device 1700, a $2^{nd}$ electronic device 1710 and a hearing aid 1720 are illustrated, where the $1^{st}$ electronic device 1700 may decide a microphone array such that a sound signal collected through a microphone 1702 of the $1^{st}$ electronic device 1700, a microphone 1712 of the $2^{nd}$ electronic device 1710, and at least one microphone 1722 and/or 1724 of the hearing aid 1720 is focused in a specific direction. Corresponding to the microphone array, the $1^{st}$ electronic device 1700 may control activation/inactivation of at least one microphone among the microphone 1702 of the $1^{st}$ electronic device 1700, the microphone 1712 of the $2^{nd}$ electronic device 1710, and/or the at least one microphone 1722 and/or 1724 of the hearing aid 1720. Here, the $2^{nd}$ electronic device 1710 may include a wearable device.

In the aforementioned embodiment, the electronic device 200, as illustrated in FIG. 2, may control a microphone sensitivity of the hearing aid 300, as illustrated in FIG. 3, whose communication is performed. In this regard, as in FIG. 17, the electronic device 200 may communicate with the hearing aid 300 for controlling microphone sensitivity, using an electronic tag of the hearing aid 300.

Figure 18:
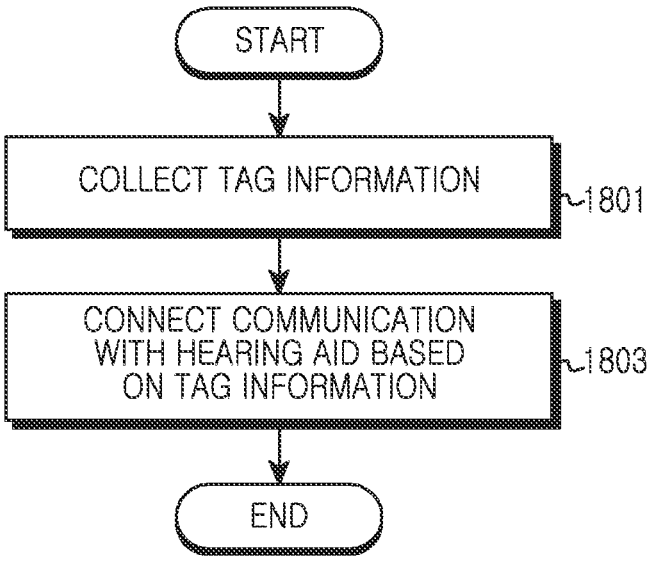
FIG. 18 illustrates a procedure for connecting with a hearing aid in an electronic device according to an embodiment of the present disclosure.

FIG. 18 illustrates a procedure for connecting with a hearing aid in an electronic device according to an embodiment of the present disclosure.

Referring to FIG. 18, a procedure is illustrated, such that in operation 1801, the electronic device may collect tag information of a hearing aid for controlling a microphone sensitivity, from an electronic tag such as an NFC tag. For example, the electronic device may collect tag information of a hearing aid from an electronic tag inserted to the corresponding hearing aid. Furthermore, for example, the electronic device may collect tag information of the hearing aid from an electronic tag existing in a place separate from the hearing aid such as a product box of the hearing aid or a retailer thereof. Here, the tag information of the hearing aid may include one or more of identification information of the hearing aid and communication link setting information of the hearing aid.

In operation 1803, the electronic device may communicate with the corresponding hearing aid based on the tag information of the hearing aid. For example, the electronic device may search if a hearing aid connectable for microphone sensitivity control exists based on tag information of the hearing aid. If the hearing aid is located, the electronic device may communicate with the corresponding hearing aid (e.g., operation 501 of FIG. 5). Furthermore, for example, the electronic device may search if a hearing aid connectable for microphone sensitivity control exists based on tag information of the hearing aid. If the hearing aid is located, the electronic device may transmit a microphone sensitivity control signal to the corresponding hearing aid (e.g., operation 503 of FIG. 5).

According to various embodiments of the present disclosure, an operation method of an electronic device may include the operations of transmitting a control signal for controlling a microphone sensitivity of a hearing aid, to the hearing aid, and transmitting a reception signal provided from a counterpart electronic device to the hearing aid.

In an embodiment of the present disclosure, the operation of transmitting the reception signal to the hearing aid may include the operation of transmitting the reception signal provided from the counterpart electronic device to the hearing aid using a short-range communication method.

In an embodiment of the present disclosure, the short-range communication method may include one or more of WiFi, Bluetooth, and/or NFC.

In an embodiment of the present disclosure, the operation of transmitting the reception signal to the hearing aid may include the operation of transmitting the reception signal provided from the counterpart electronic device, to the hearing aid using a Bluetooth Low Energy (BLE) protocol communication method deforming one or more of a data transmission interval or a data transmission duration.

In an embodiment of the present disclosure, the method may further include the operations of collecting a sound signal through a microphone of the electronic device, and transmitting at least a portion of the sound signal collected through the microphone of the electronic device to the hearing aid.

In an embodiment of the present disclosure, the operation of transmitting the at least portion of the sound signal to the hearing aid may include the operations of separating the sound signal collected through the microphone of the electronic device into a surrounding sound and a user voice, and transmitting the surrounding sound to the hearing aid.

In an embodiment of the present disclosure, the processor may check user's danger occurrence or non-occurrence using the sound signal collected through the microphone of the electronic device and, if sensing the user's danger occurrence, transmit a danger signal to the hearing aid through the communication module.

In an embodiment of the present disclosure, the method may further include the operation of, if an event for microphone sensitivity restoration takes place, transmitting a control signal for restoring the microphone sensitivity of the hearing aid to the hearing aid.

In an embodiment of the present disclosure, the operation of transmitting the control signal for restoring the microphone sensitivity of the hearing aid to the hearing aid may include the operation of, if an event with the counterpart electronic device has ended, transmitting the control signal for restoring the microphone sensitivity of the hearing aid to the hearing aid.

In an embodiment of the present disclosure, the operation of transmitting the control signal for restoring the microphone sensitivity of the hearing aid to the hearing aid may include the operations of checking if it provides an event service with the counterpart electronic device using a peripheral device and, if providing the event service with the counterpart electronic device using the peripheral device, transmitting the control signal for restoring the microphone sensitivity of the hearing aid to the hearing aid.

In an embodiment of the present disclosure, the method may further include the operation of, if transmitting the control signal for restoring the microphone sensitivity of the hearing aid to the hearing aid, inactivating a speaker of the electronic device.

In an embodiment of the present disclosure, the operation of transmitting the control signal for controlling the microphone sensitivity of the hearing aid to the hearing aid may include the operation of, if a telephony event with the counterpart electronic device takes place, transmitting the control signal for controlling the microphone sensitivity of the hearing aid to the hearing aid.

According to various embodiments of the present disclosure, an operation method of an electronic device may include the operations of transmitting a control signal for controlling a microphone sensitivity of a hearing aid to the hearing aid, and transmitting a sound signal collected through a microphone of the electronic device, to the hearing aid.

In an embodiment of the present disclosure, before the operation of transmitting the control signal to the hearing aid, the method may further include the operations of collecting electronic tag information of the hearing aid, and connecting communication with the hearing aid based on the electronic tag information.

According to various embodiments of the present disclosure, an operation method of a hearing aid may include the operations of controlling a microphone sensitivity of the hearing aid based on a control signal provided from an electronic device, amplifying a sound signal provided from the electronic device and outputting the amplified sound signal to a speaker of the hearing aid.

In an embodiment of the present disclosure, the operation of controlling the microphone sensitivity may include the operation of controlling the microphone sensitivity such that a microphone of the hearing aid is inactivated, based on the control signal provided from the electronic device.

In an embodiment of the present disclosure, the method may further include the operations of checking an event state with the electronic device and, if an event with the electronic device has ended or has been paused, restoring the microphone sensitivity of the hearing aid, amplifying a sound signal collected through the microphone of the hearing aid and outputting the amplified sound signal through the speaker of the hearing aid.

In an embodiment of the present disclosure, the method may further include the operations of, if receiving a control signal for restoring the microphone sensitivity of the hearing aid from the electronic device, restoring the microphone sensitivity of the hearing aid, amplifying a sound signal collected through the microphone of the hearing aid and outputting the amplified sound signal through the speaker of the hearing aid.

In accordance to various embodiments of the present disclosure, if a hearing aid is connected with an electronic device, the hearing aid may collect a sound signal using a microphone of the electronic device, thereby preventing a feedback phenomenon of the hearing aid.

In accordance to various embodiments of the present disclosure, upon telephony service provision, a hearing aid may inactivate a microphone of the hearing aid, and amplify and output a call reception signal provided from the electronic device, thereby preventing a feedback phenomenon of the hearing aid.

In accordance to various embodiments of the present disclosure, an electronic device may perform digital signal processing such as noise removal for a sound signal collected using a microphone of the electronic device and transmit the digital-signal-processed sound signal to a hearing aid, thereby improving a sound quality of the hearing aid.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of operating an electronic device, the method comprising:

transmitting, by the electronic device, a control signal for controlling a microphone sensitivity of a hearing aid, to the hearing aid;

transmitting a reception signal provided from a counterpart electronic device to the hearing aid;

checking if the electronic device provides an event service with the counterpart electronic device using a peripheral device; and transmitting the control signal for restoring the microphone sensitivity of the hearing aid to the hearing aid if the electronic device provides the event service with the counterpart electronic device using the peripheral device.

2. The method of claim 1, wherein the transmitting of the reception signal to the hearing aid comprises transmitting the reception signal provided from the counterpart electronic device to the hearing aid using a short-range communication method.

3. The method of claim 1, wherein the transmitting of the reception signal to the hearing aid comprises transmitting the reception signal provided from the counterpart electronic device to the hearing aid using a bluetooth low energy (BLE) protocol communication method deforming one or more of a data transmission interval and a data transmission duration.

4. The method of claim 1, further comprising:

collecting a sound signal through a microphone of the electronic device; and transmitting at least a portion of the sound signal collected through the microphone of the electronic device to the hearing aid.

5. The method of claim 4, wherein the transmitting of the at least the portion of the sound signal to the hearing aid comprises:

separating the sound signal collected through the microphone of the electronic device into a surrounding sound and a user voice; and transmitting the surrounding sound to the hearing aid.

6. The method of claim 1, further comprising, if an event with the counterpart electronic device has ended, transmitting the control signal for restoring the microphone sensitivity of the hearing aid to the hearing aid.

7. The method of claim 1, further comprising, if the control signal for controlling the microphone sensitivity of the hearing aid is transmitted to the hearing aid, inactivating a speaker of the electronic device.

8. The method of claim 1, wherein the transmitting of the control signal for controlling the microphone sensitivity of the hearing aid to the hearing aid comprises, if a telephony event with the counterpart electronic device takes place, transmitting the control signal for controlling the microphone sensitivity of the hearing aid to the hearing aid.

9. The method of claim 1, wherein the transmitting of the reception signal to the hearing aid comprises:

checking if a danger situation is sensed based on a sound signal received from a microphone of the electronic device; and transmitting, if the danger situation is sensed, a danger signal to the hearing aid.

10. A method of operating an electronic device, the method comprising:

transmitting, by the electronic device, a control signal for controlling a microphone sensitivity of a hearing aid, to the hearing aid;

transmitting a sound signal collected through a microphone of the electronic device, to the hearing aid;

checking if the electronic device provides a telephony service with a counterpart electronic device using a peripheral device; and if the electronic device provides the telephony service with the counterpart electronic device using the peripheral device, transmitting the control signal for restoring the microphone sensitivity of the hearing aid to the hearing aid.

11. The method of claim 10, further comprising, before the transmitting of the control signal to the hearing aid:

collecting electronic tag information of the hearing aid; and communicating with the hearing aid based on the electronic tag information.

12. A method of operating a hearing aid, the method comprising:

controlling, by the hearing aid, a microphone sensitivity of the hearing aid based on a control signal provided from an electronic device;

amplifying a sound signal provided from the electronic device;

outputting the amplified sound signal to a speaker of the hearing aid; and receiving, from the electronic device, a control signal for restoring the microphone sensitivity of the hearing aid, wherein the electronic device is configured to:

check if the electronic device provides a telephony service with a counterpart electronic device using a peripheral device, and transmit the control signal for restoring the microphone sensitivity of the hearing aid to the hearing aid if the electronic device provides the telephony service with the counterpart electronic device using the peripheral device.

13. The method of claim 12, wherein the controlling of the microphone sensitivity comprises controlling the microphone sensitivity such that a microphone of the hearing aid is inactivated, based on the control signal provided from the electronic device.

14. The method of claim 12, further comprising:

checking a state of an event with the electronic device;

restoring, if the event with the electronic device has ended or has been paused, the microphone sensitivity of the hearing aid;

amplifying a sound signal collected through the microphone of the hearing aid; and outputting the amplified sound signal through the speaker of the hearing aid.

15. The method of claim 12, further comprising:

restoring, if the control signal for restoring the microphone sensitivity of the hearing aid is received from the electronic device, the microphone sensitivity of the hearing aid;

amplifying a sound signal collected through the microphone of the hearing aid; and outputting the amplified sound signal through the speaker of the hearing aid.

16. An electronic device comprising:

a microphone;

a speaker;

a transceiver; and at least one processor configured to:

transmit a control signal for controlling a microphone sensitivity of a hearing aid, to the hearing aid through the transceiver, transmit a reception signal provided from a counterpart electronic device to the hearing aid through the transceiver, check if the electronic device provides an event service with the counterpart electronic device using a peripheral device, and if the electronic device provides the event service with the counterpart electronic device using the peripheral device, transmit a control signal for restoring the microphone sensitivity of the hearing aid to the hearing aid.

17. The electronic device of claim 16, wherein the transceiver is further configured to communicate with the hearing aid using a short-range communication method.

18. The electronic device of claim 16, wherein the transceiver is further configured to communicate with the hearing aid using a bluetooth low energy (BLE) protocol communication method deforming one or more of a data transmission interval and a data transmission duration.

19. The electronic device of claim 16, wherein the at least one processor is further configured to transmit at least a portion of a sound signal collected through the microphone of the electronic device to the hearing aid through the transceiver.

20. The electronic device of claim 19, wherein the at least one processor is further configured to:

separate the sound signal collected through the microphone of the electronic device into a surrounding sound and a user voice; and transmit the surrounding sound to the hearing aid through the transceiver.

21. The electronic device of claim 16, wherein, if an event with the counterpart electronic device has ended, the at least one processor is further configured to transmit the control signal for restoring the microphone sensitivity of the hearing aid to the hearing aid through the transceiver.

22. The electronic device of claim 16, wherein, if the control signal for controlling a microphone sensitivity of the hearing aid is transmitted to the hearing aid, the at least one processor is further configured to inactivate a speaker of the electronic device.

23. The electronic device of claim 16, wherein, if a telephony event with the counterpart electronic device takes place, the at least one processor is further configured to transmit the control signal for controlling the microphone sensitivity of the hearing aid to the hearing aid through the transceiver.

24. An electronic device comprising:

a microphone;

a speaker;

a transceiver; and at least one processor configured to:

transmit a control signal for controlling a microphone sensitivity of a hearing aid to the hearing aid through the transceiver, transmit a sound signal collected through a microphone of the electronic device, to the hearing aid, check if the electronic device provides a telephony service with a counterpart electronic device using a peripheral device, and if the electronic device provides the telephony service with the counterpart electronic device using the peripheral device, transmit a control signal for restoring the microphone sensitivity of the hearing aid to the hearing aid.

25. The electronic device of claim 24, wherein the transceiver is further configured to:

collect electronic tag information of the hearing aid; and communicate with the hearing aid based on the electronic tag information.

26. A hearing aid apparatus comprising:

at least one microphone;

a speaker;

a transceiver; and at least one processor configured to:

control a microphone sensitivity of the hearing aid based on a control signal provided from an electronic device, amplify a sound signal provided from the electronic device through the transceiver, output the amplified sound signal to a speaker of the hearing aid, and receive, from the electronic device, a control signal for restoring the microphone sensitivity of the hearing aid, wherein the electronic device is configured to:

check if the electronic device provides a telephony service with a counterpart electronic device using a peripheral device, and transmit the control signal for restoring the microphone sensitivity of the hearing aid to the hearing aid if the electronic device provides the telephony service with the counterpart electronic device using the peripheral device.

27. The hearing aid apparatus of claim 26, wherein the at least one processor is further configured to control the microphone sensitivity such that the at least one microphone of the hearing aid is inactivated, based on the control signal provided from the electronic device.

28. The hearing aid apparatus of claim 26, wherein, if an event with the electronic device has ended or has been paused, the at least one processor is further configured to:

restore the microphone sensitivity of the hearing aid;

amplify a sound signal collected through the at least one microphone of the hearing aid; and output the amplified sound signal through the speaker of the hearing aid.

29. The hearing aid apparatus of claim 26, wherein, if the control signal for restoring the microphone sensitivity of the hearing aid is received from the electronic device through the transceiver, the at least one processor is further configured to:

restore the microphone sensitivity of the hearing aid;

amplify a sound signal collected through the at least one microphone of the hearing aid; and output the amplified sound signal through the speaker of the hearing aid.

* * * * *